US009950843B2

(12) United States Patent
Kitano et al.

(10) Patent No.: US 9,950,843 B2
(45) Date of Patent: Apr. 24, 2018

(54) PACKAGING CONTAINER

(71) Applicant: SHINKO CHEMICAL CO., LTD., Ishikawa (JP)

(72) Inventors: Yumiko Kitano, Ishikawa (JP); Atsushi Doi, Ishikawa (JP)

(73) Assignee: SHINKO CHEMICAL CO., LTD., Ishikawa (JP)

( * ) Notice: Subject to any disclaimer, the term of this patent is extended or adjusted under 35 U.S.C. 154(b) by 0 days.

(21) Appl. No.: 15/515,240

(22) PCT Filed: Nov. 16, 2015

(86) PCT No.: PCT/JP2015/082115

§ 371 (c)(1),
(2) Date: Mar. 29, 2017

(87) PCT Pub. No.: WO2016/080345

PCT Pub. Date: May 26, 2016

(65) Prior Publication Data

US 2017/0233149 A1 Aug. 17, 2017

(30) Foreign Application Priority Data

Nov. 18, 2014 (JP) ..... 2014-233278

(51) Int. Cl.
*B65D 41/17* (2006.01)
*B65D 25/42* (2006.01)

(52) U.S. Cl.
CPC ..... *B65D 41/17* (2013.01); *B65D 25/42* (2013.01)

(58) Field of Classification Search
CPC ..... B65D 25/42; B65D 50/046; B65D 43/26; B65D 43/0204; B65D 43/0237
(Continued)

(56) References Cited

U.S. PATENT DOCUMENTS 3,430,798 A * 3/1969 Goyet ..... B65D 41/17 215/295
4,303,175 A * 12/1981 Lux ..... B65D 83/40 220/281
(Continued)

FOREIGN PATENT DOCUMENTS

JP 03-015480 4/1991
JP 04-024817 6/1992
(Continued)

OTHER PUBLICATIONS

International Search Report dated Feb. 9, 2016 in International (PCT) Application No. PCT/JP2015/082115.

*Primary Examiner* — King M Chu
(74) *Attorney, Agent, or Firm* — Wenderoth, Lind & Ponack, L.L.P.

(57) ABSTRACT

A packaging container has an improved degree of freedom in the shapes of a container body and a cap, and prevents required turning force from being excessively large. The packaging container includes a container body having an upward-facing mouth, and a cap for closing the mouth. The container body has a plurality of axial drive ribs and a circumferential locking groove formed on an outer perimeter of the mouth. The cap has protruding rib portions on an inner surface side and locking claws to elastically lock into the locking groove, extended down from a top surface thereof.

17 Claims, 23 Drawing Sheets

(58) Field of Classification Search
USPC ..... 220/281, 260, 780
See application file for complete search history.

(56) References Cited

U.S. PATENT DOCUMENTS

| | | | | |
|---|---|---|---|---|
| 8,701,909 | B2 * | 4/2014 | Endert | B65D 43/0212 215/216 |
| 2011/0024426 | A1 * | 2/2011 | Kokubo | B65D 41/485 220/315 |
| 2011/0031207 | A1 * | 2/2011 | Kokubo | A61F 9/0008 215/43 |

FOREIGN PATENT DOCUMENTS

| | | |
|---|---|---|
| JP | 06-039714 | 10/1994 |
| JP | 10-329855 | 12/1998 |
| JP | 3142618 | 6/2008 |
| JP | 2009-249007 | 10/2009 |
| JP | 2012-081988 | 4/2012 |

* cited by examiner

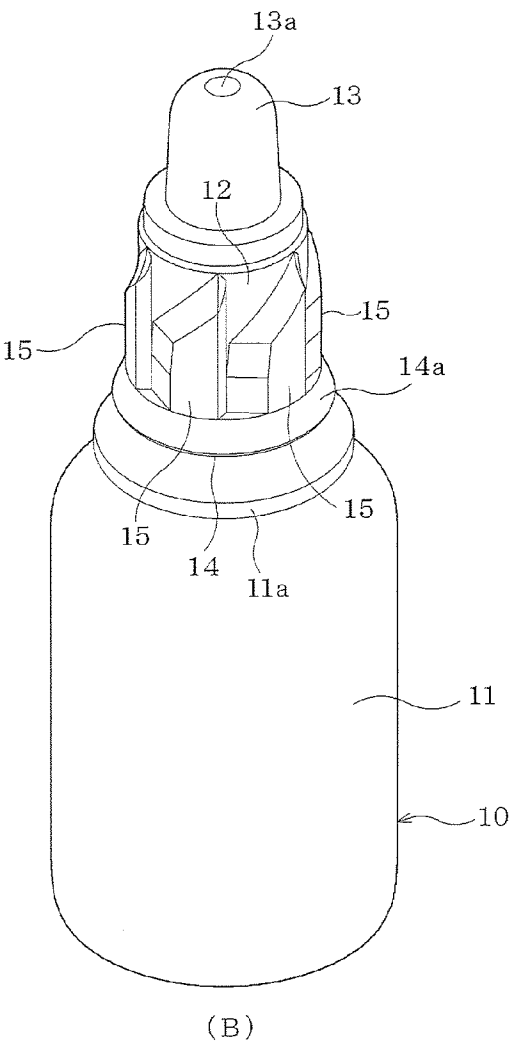
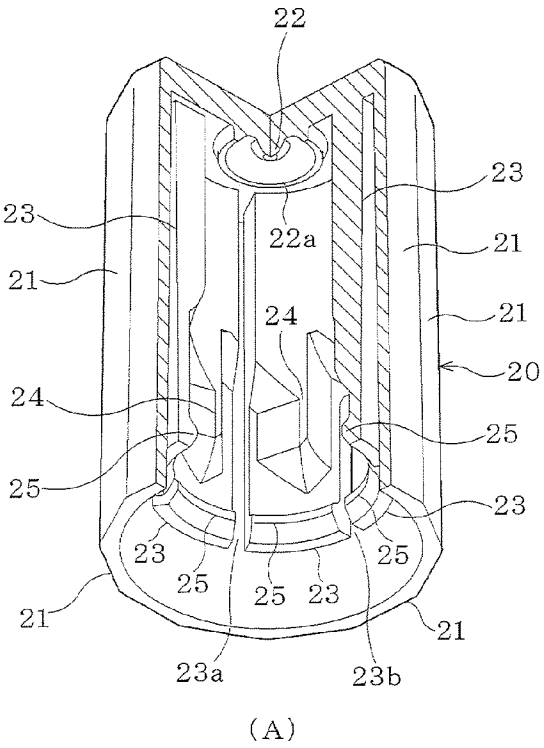
[Fig.1]

[Fig.2]
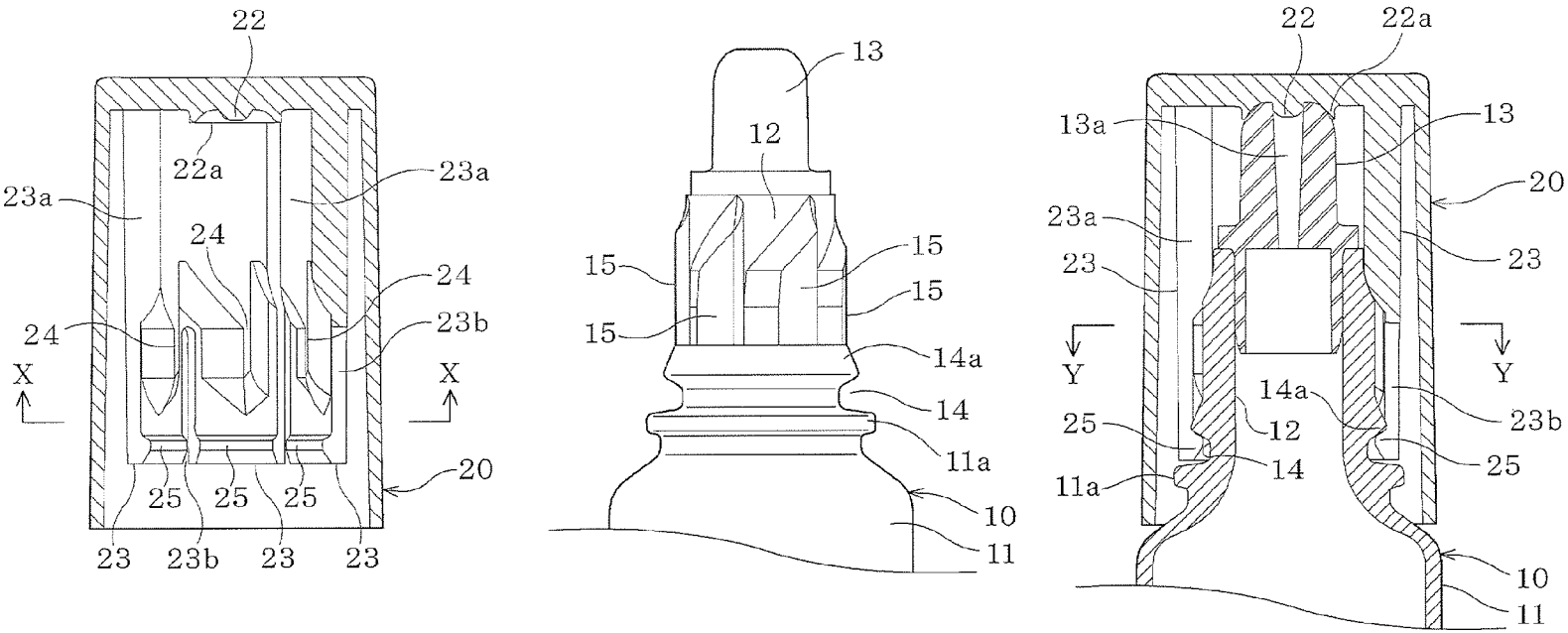

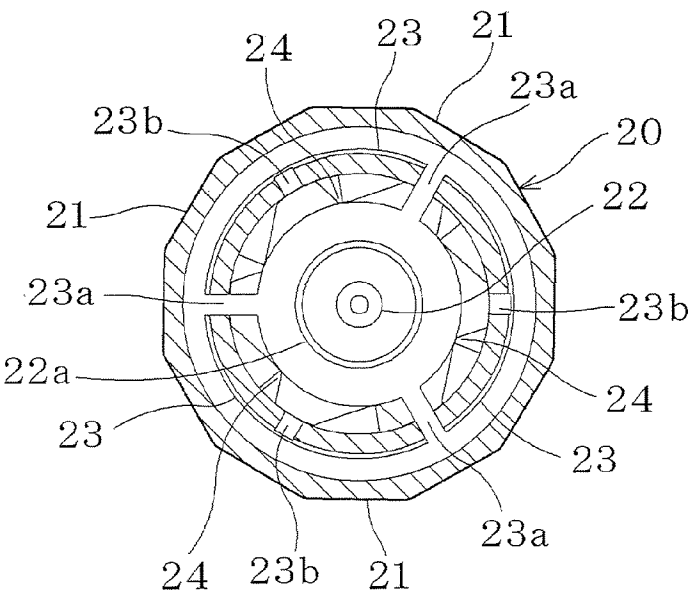
(A)
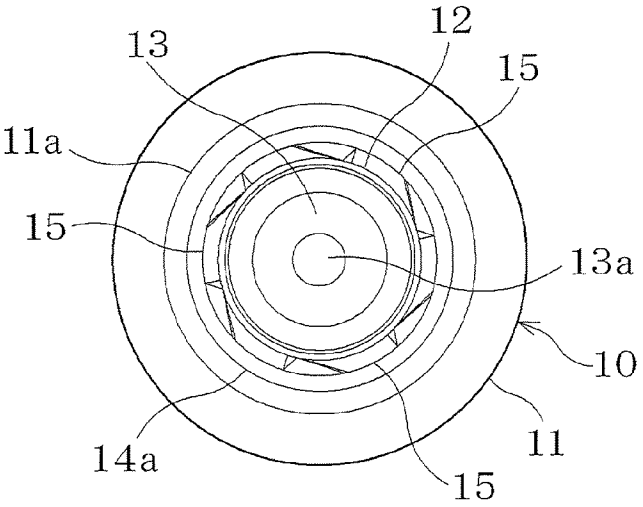
(B)
[Fig.3]

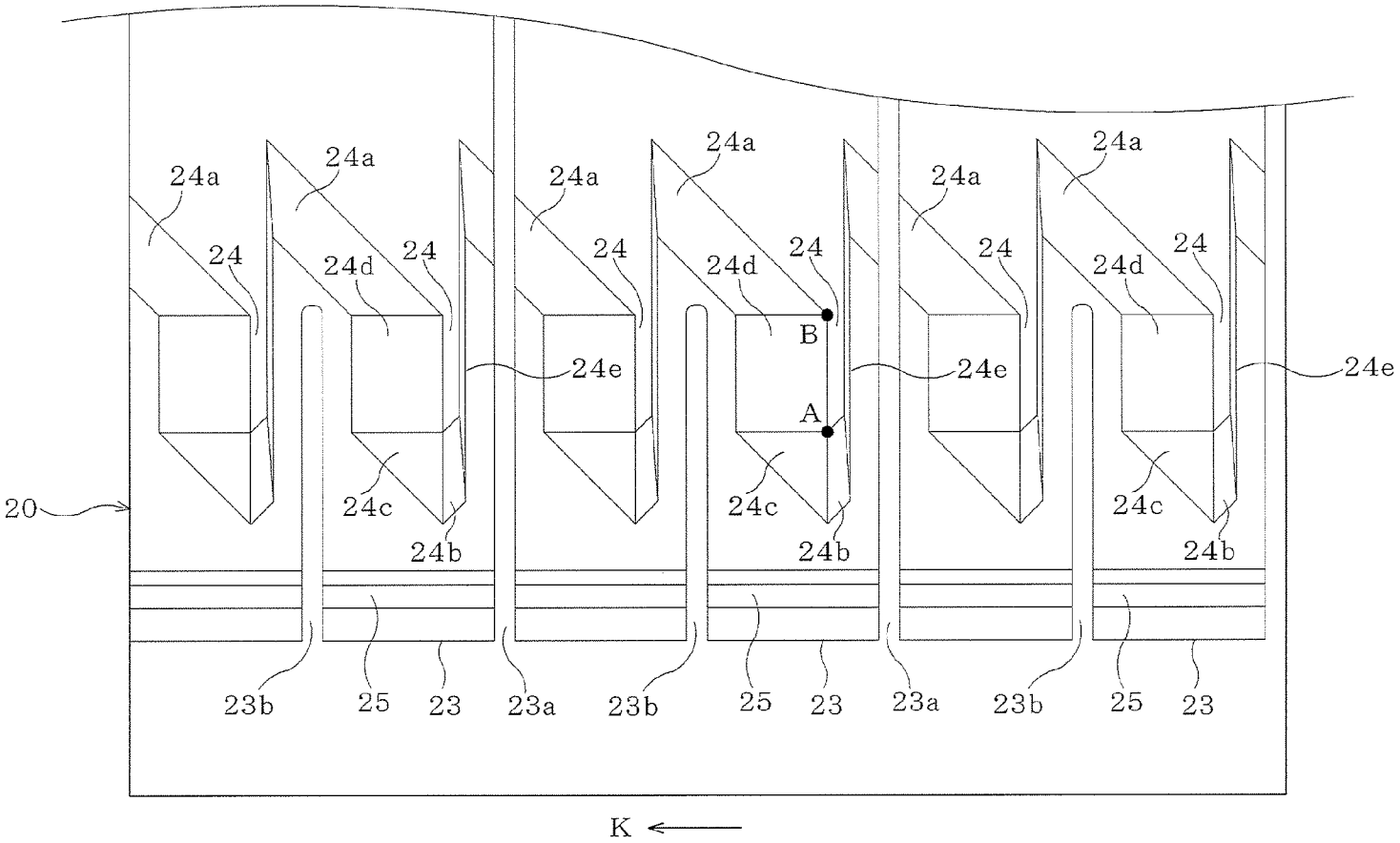
[Fig.4]

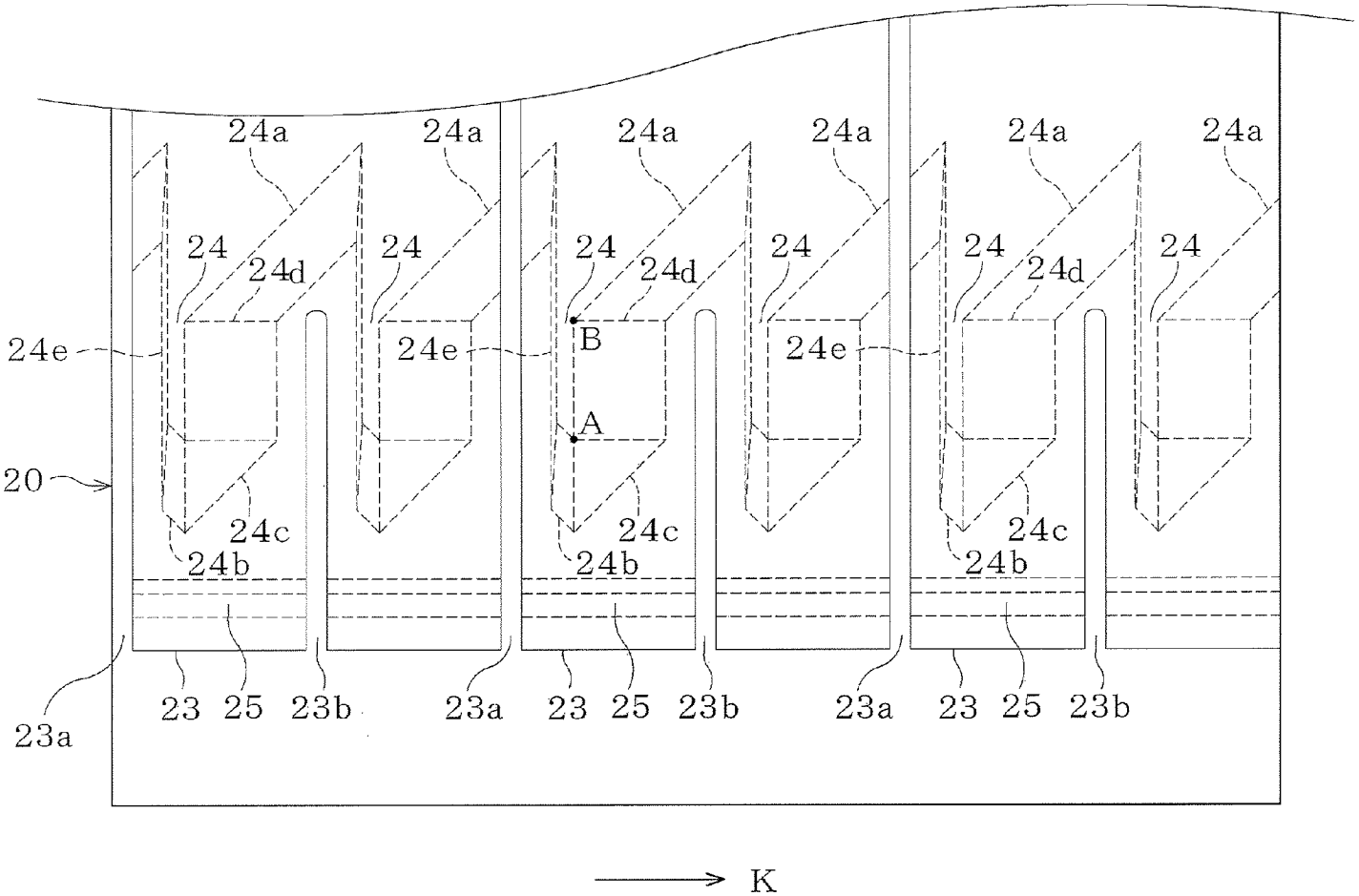
[Fig.5]

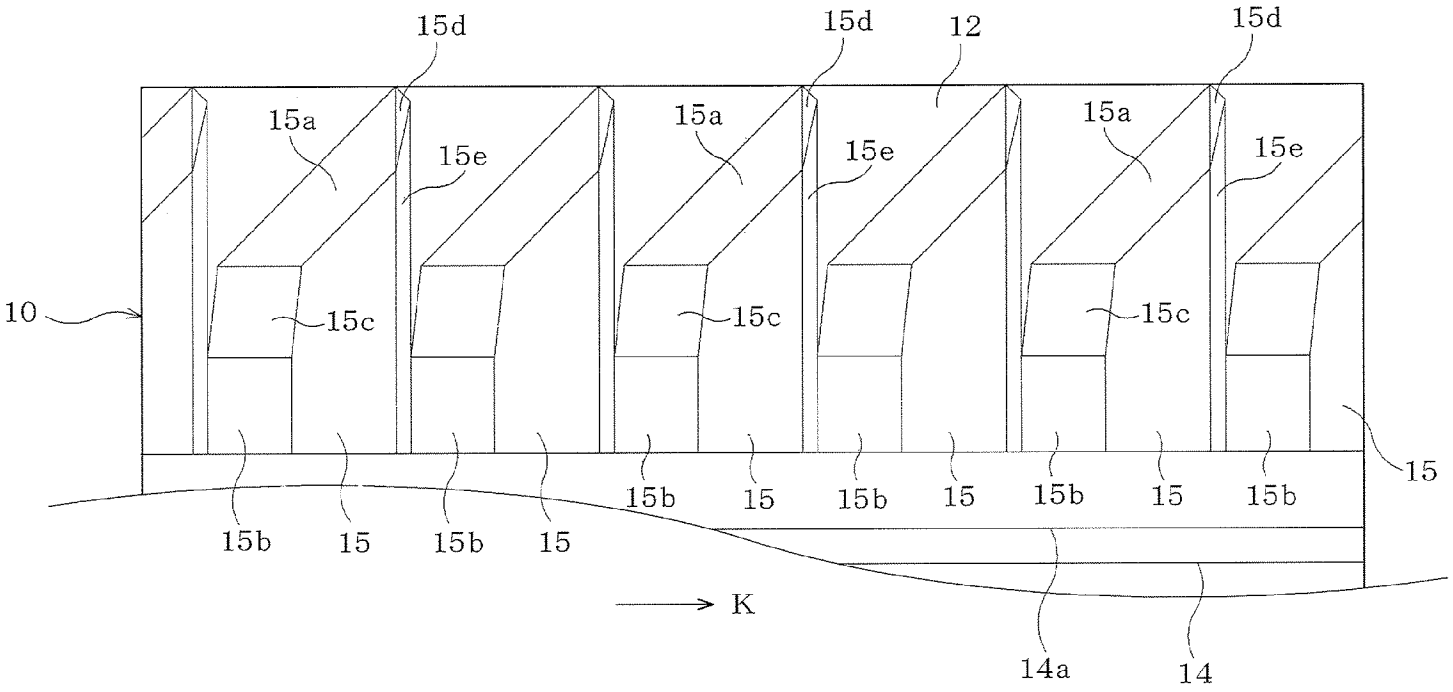
[Fig.6]

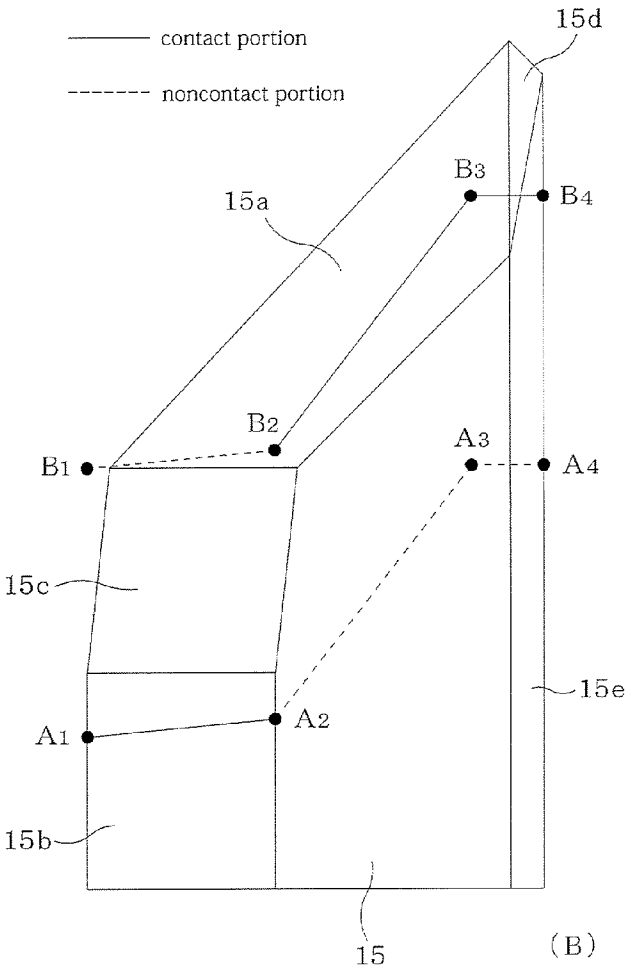
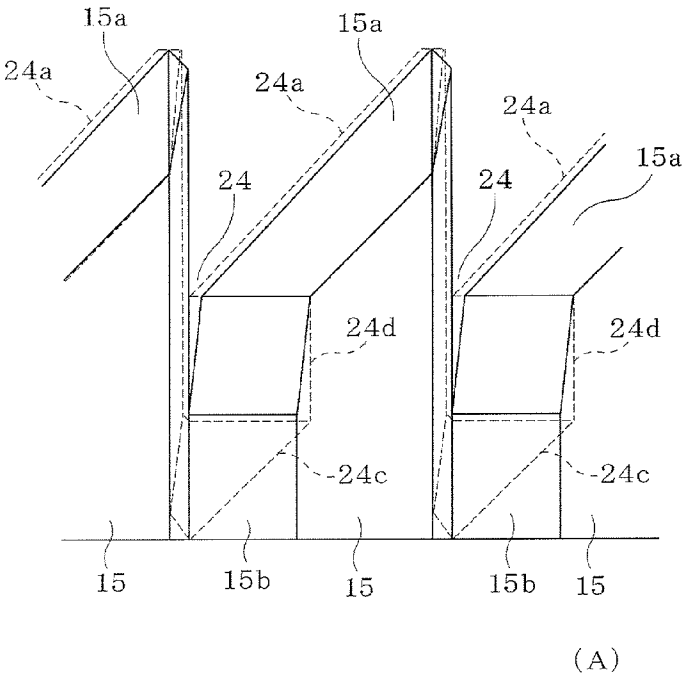
[Fig.7]

[Fig.8]
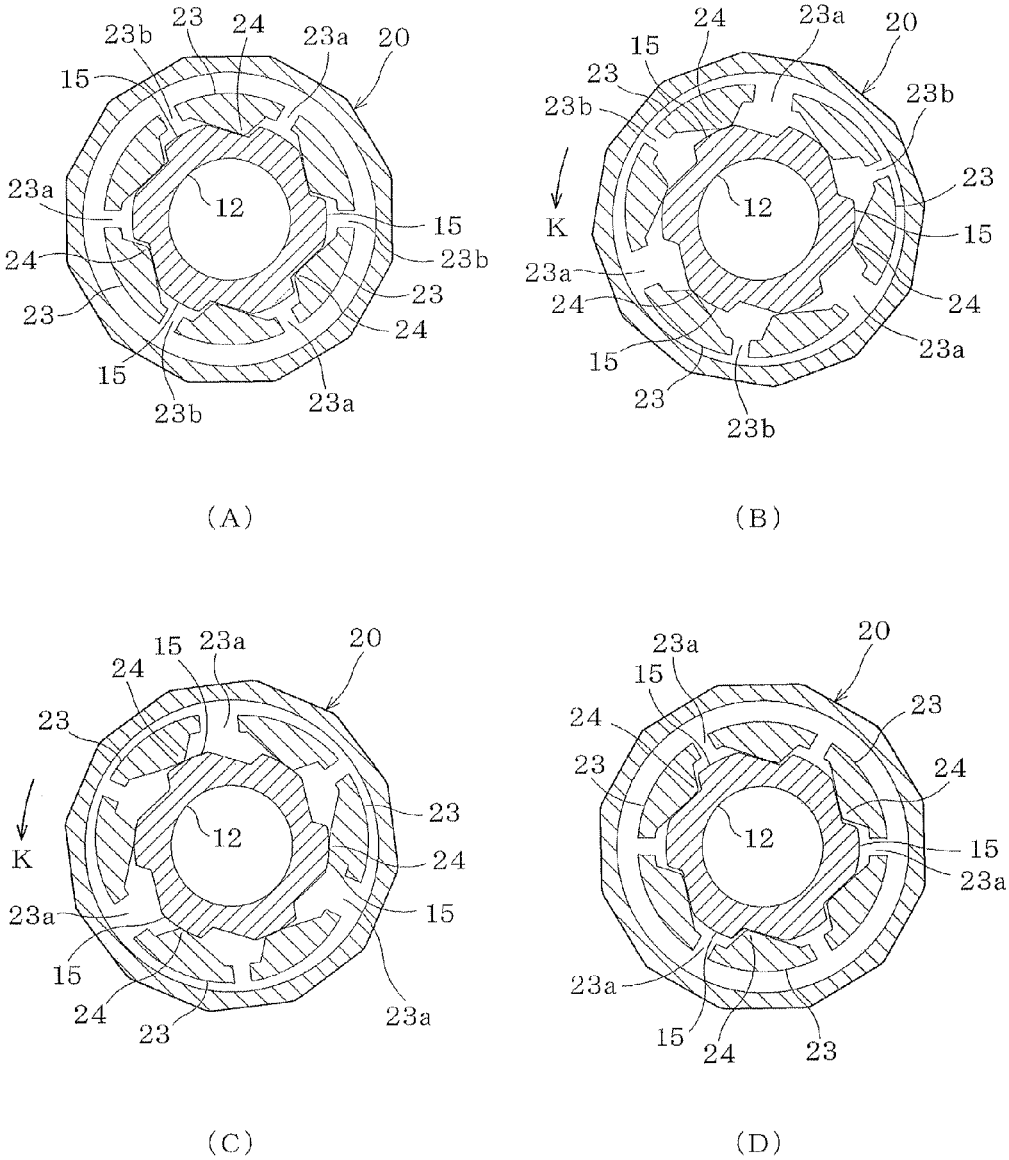

[Fig.9]
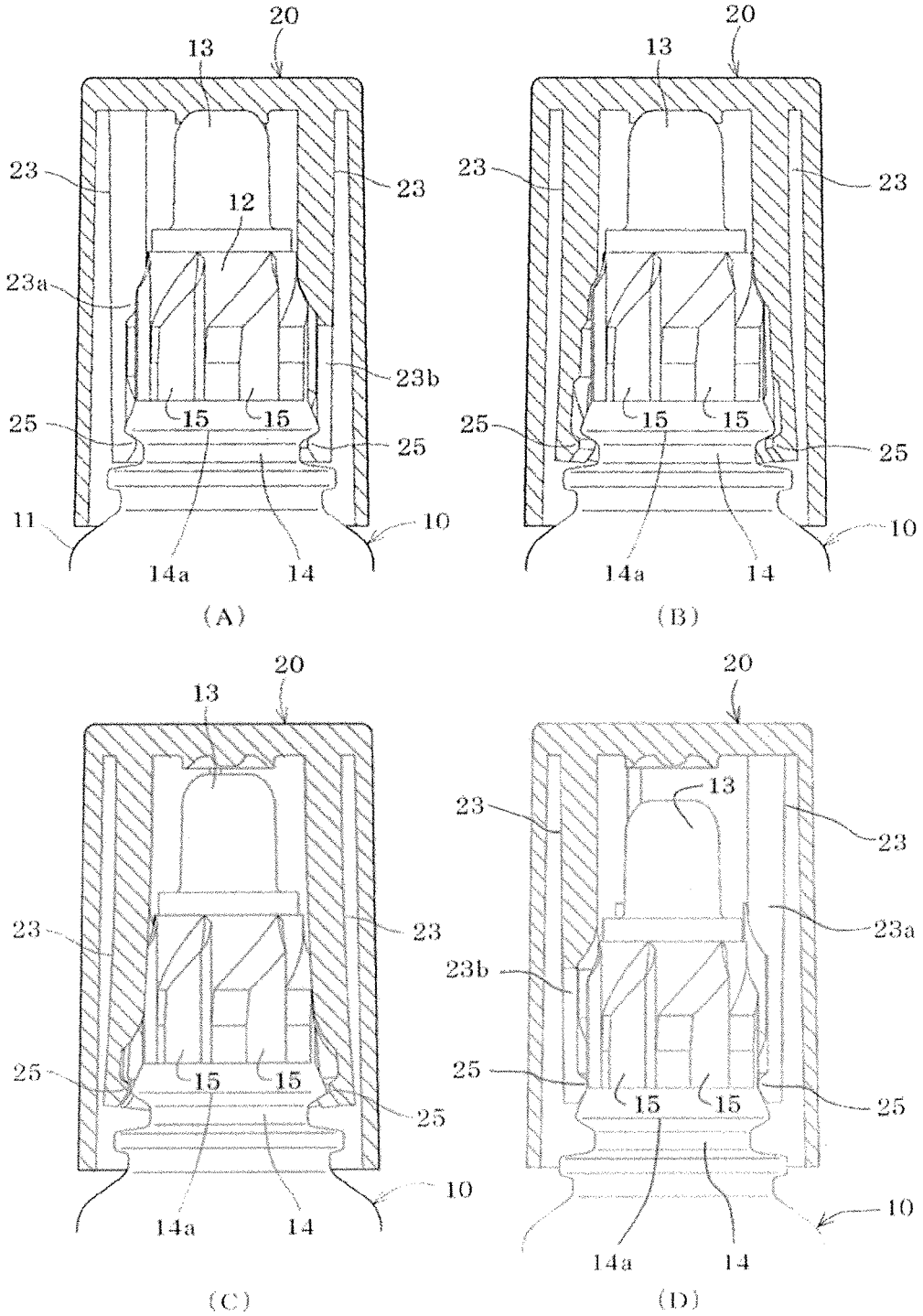

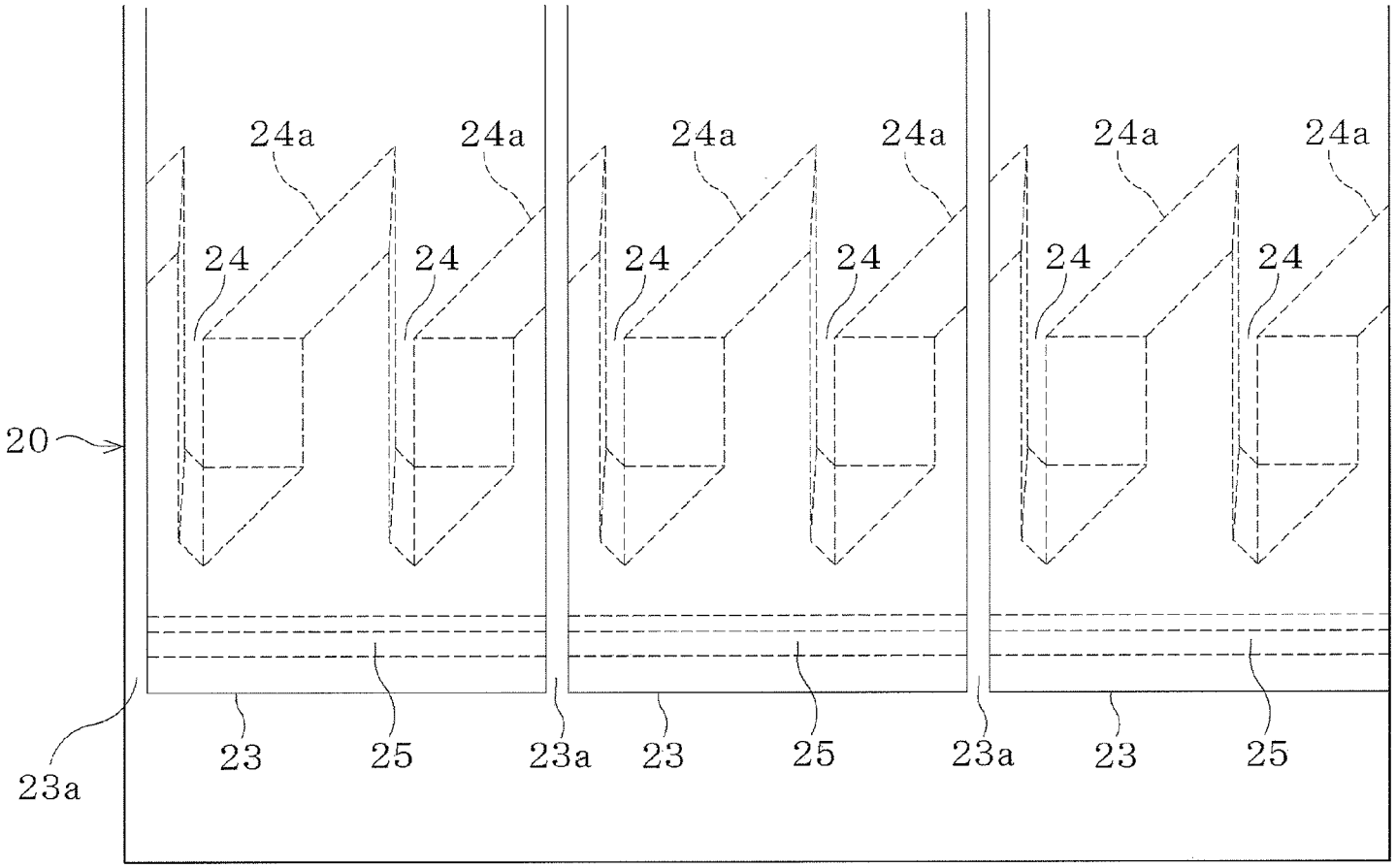
[Fig.10]

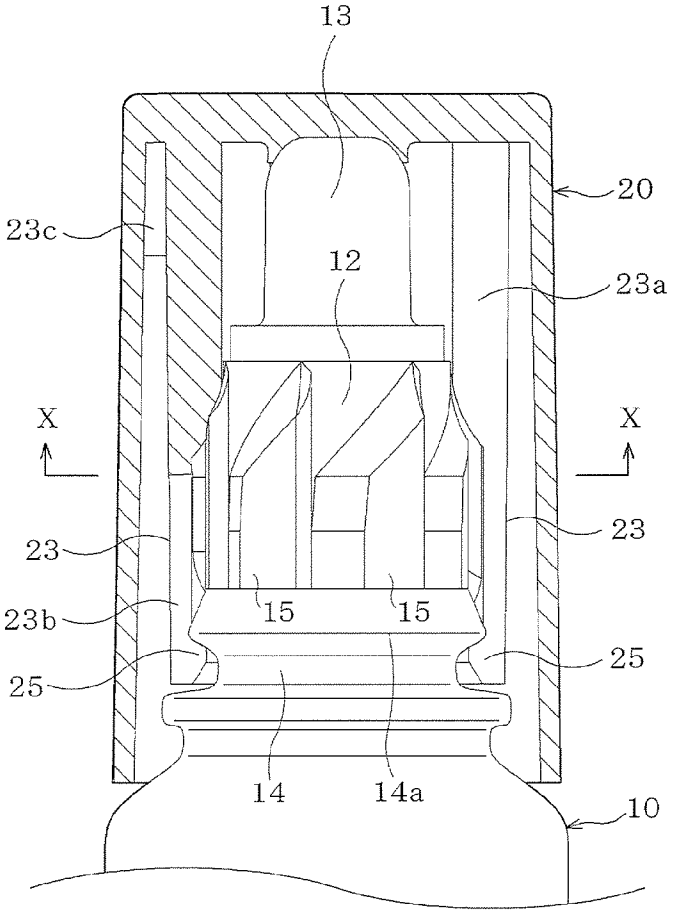
(A)
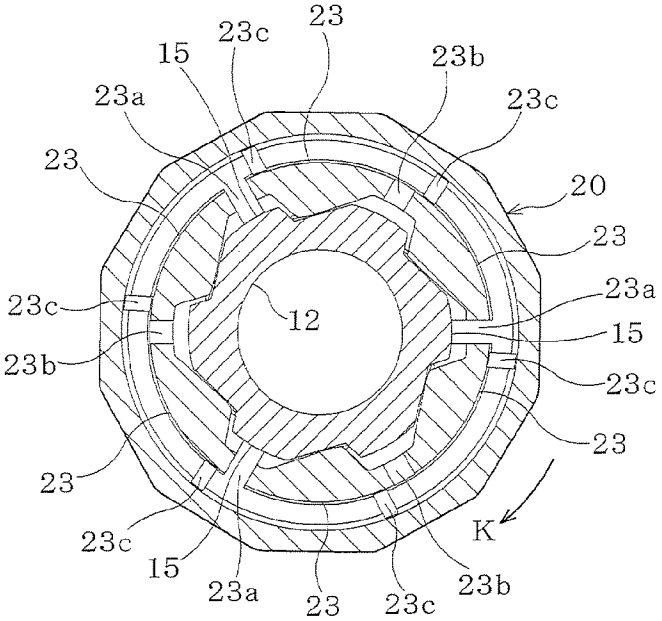
(B)
[Fig.11]

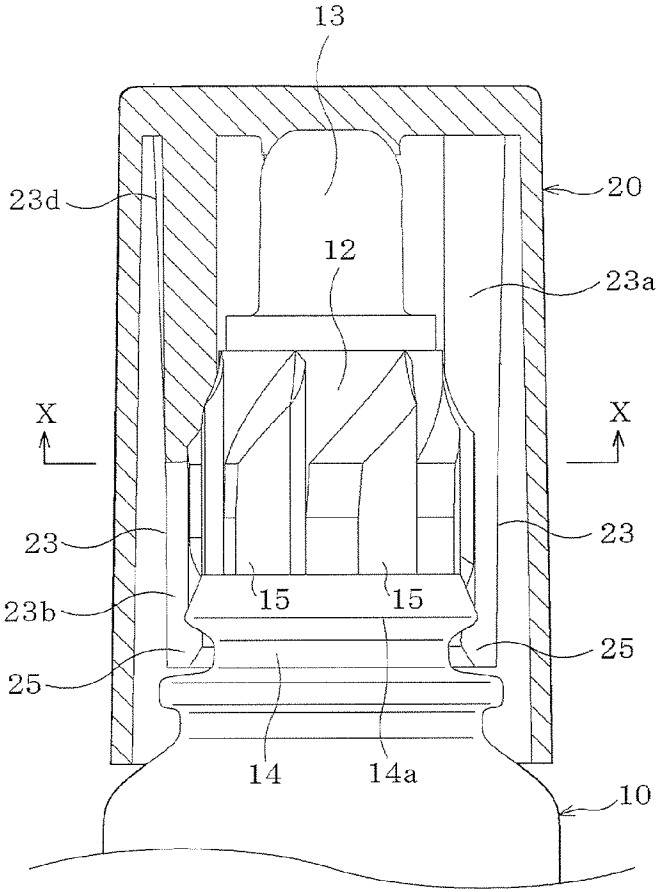
(A)
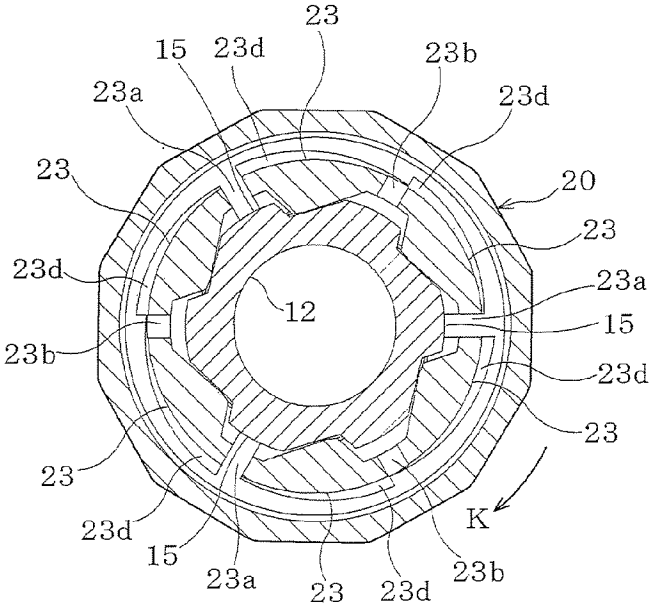
(B)
[Fig.12]

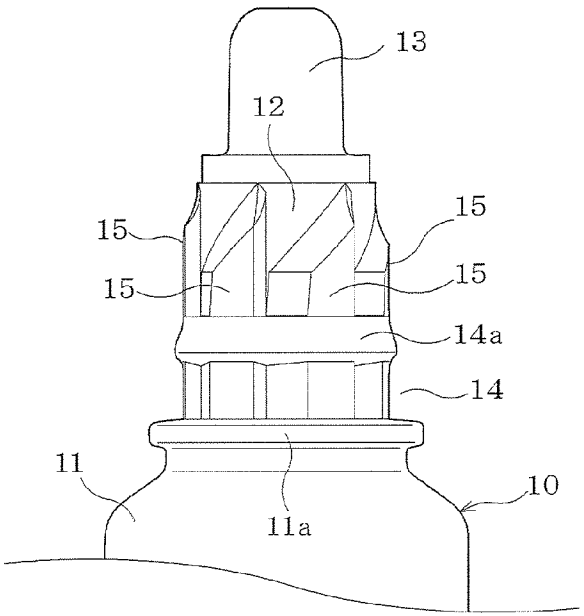
(B)
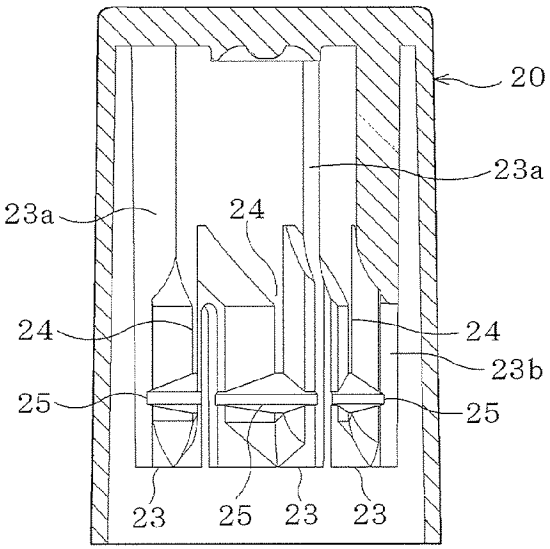
(A)
[Fig.13]

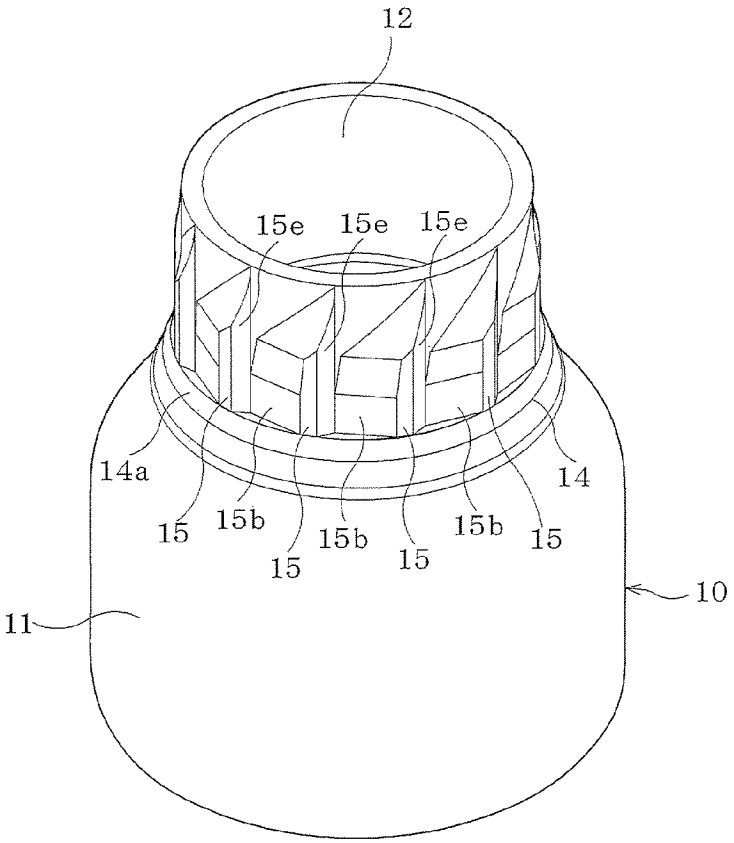
(B)
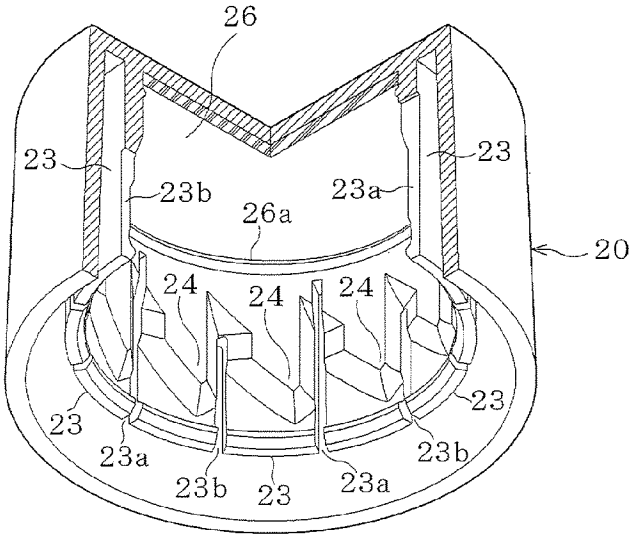
(A)
[Fig.14]

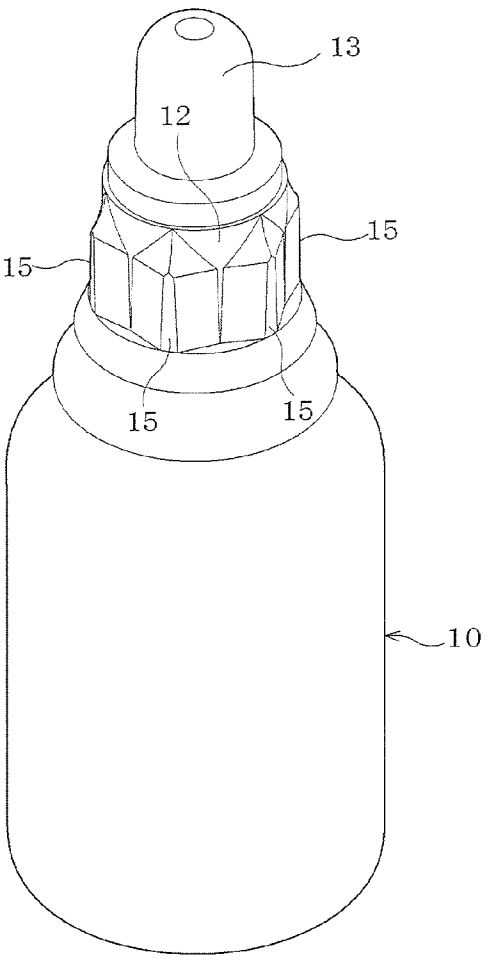
(B)
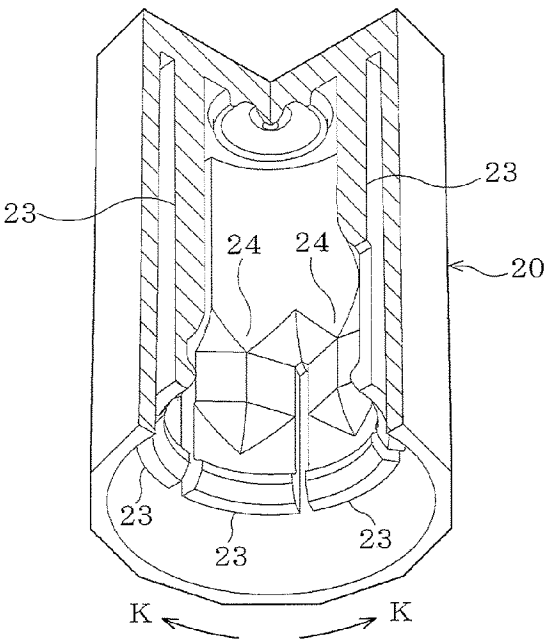
(A)
[Fig.15]

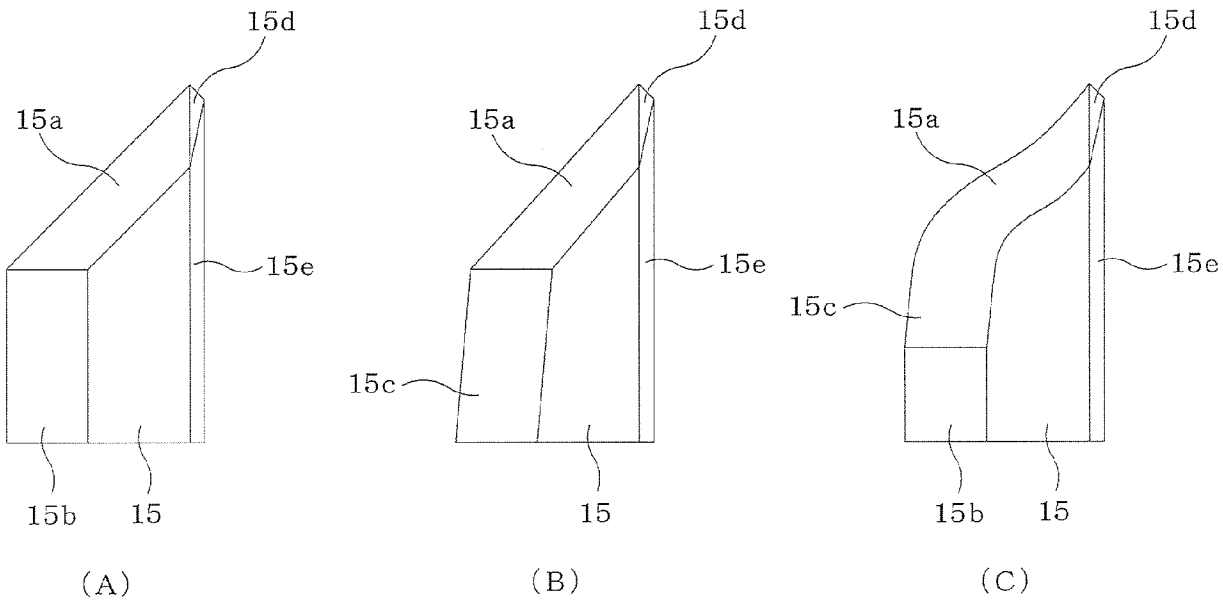
[Fig.16]

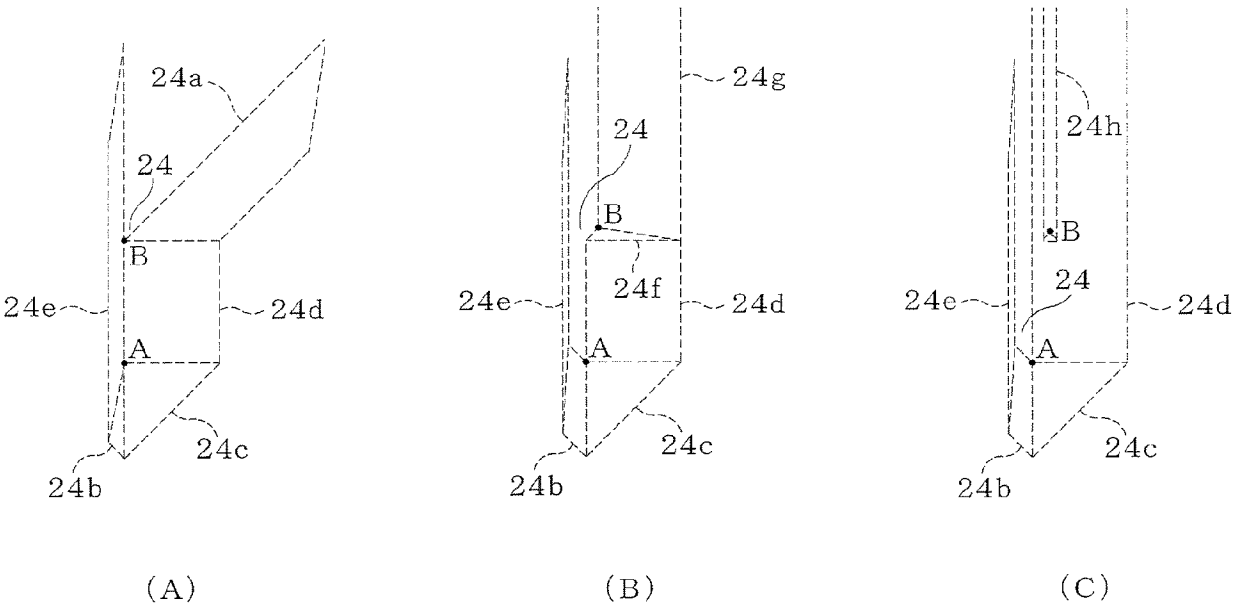
[Fig.17]

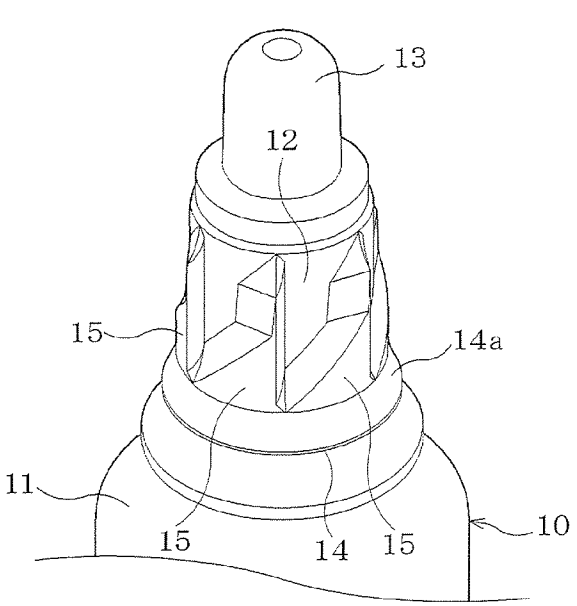
(B)
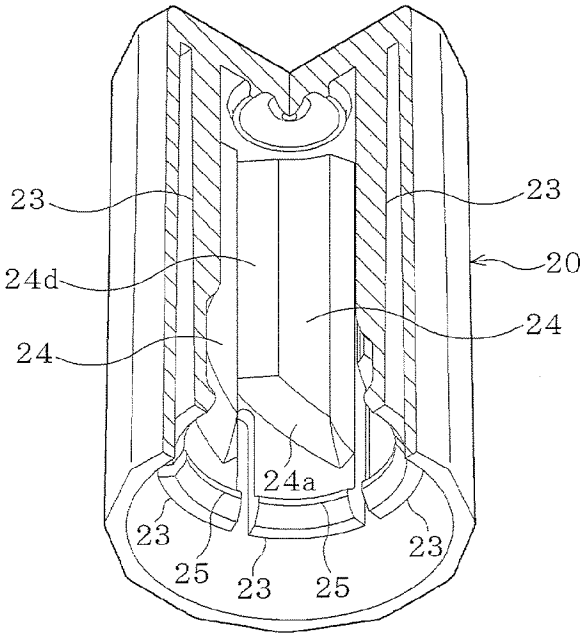
(A)
[Fig.18]

[Fig.19]
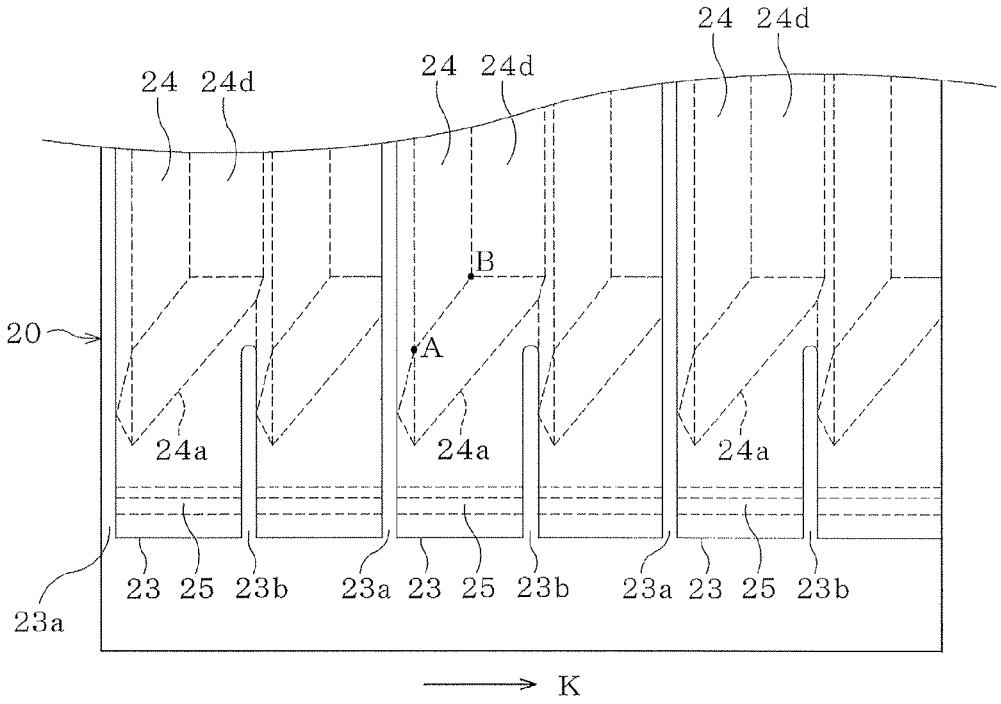
(A)
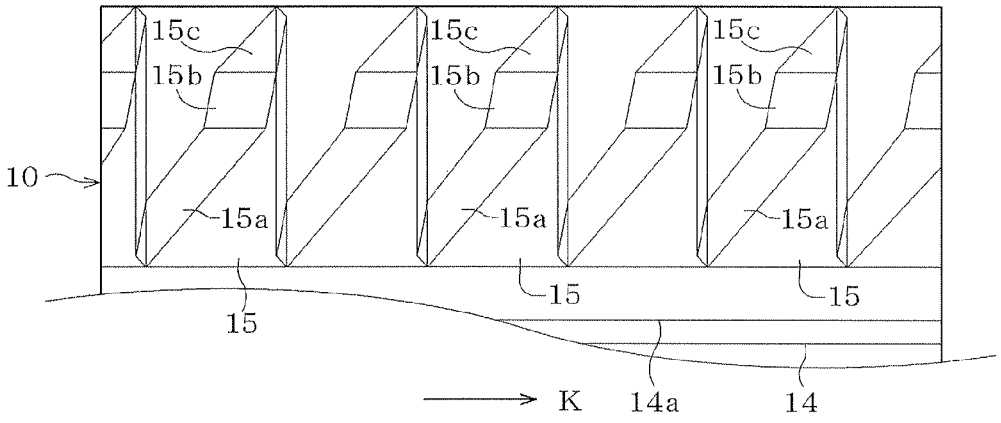
(B)

[Fig.20]
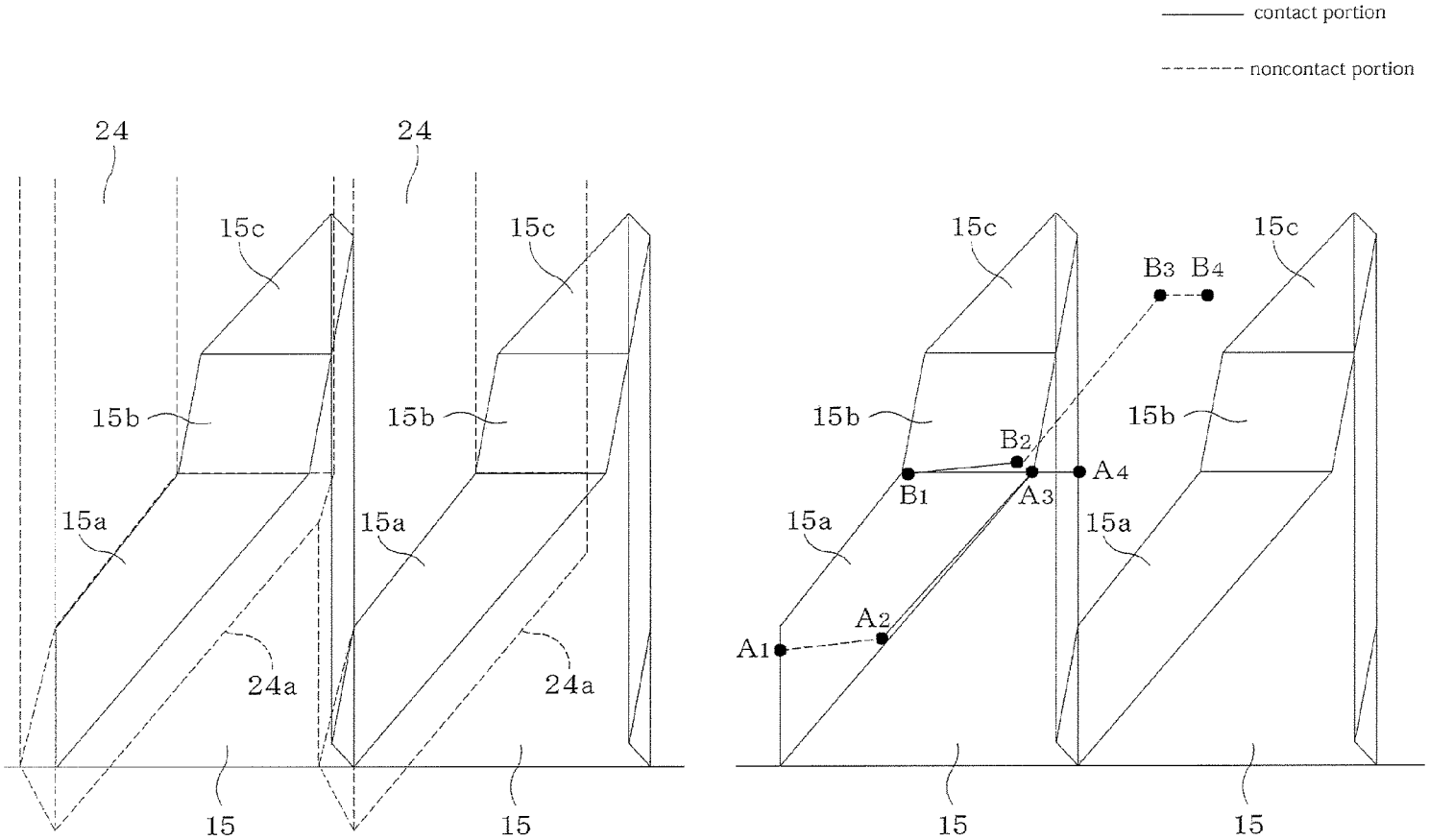

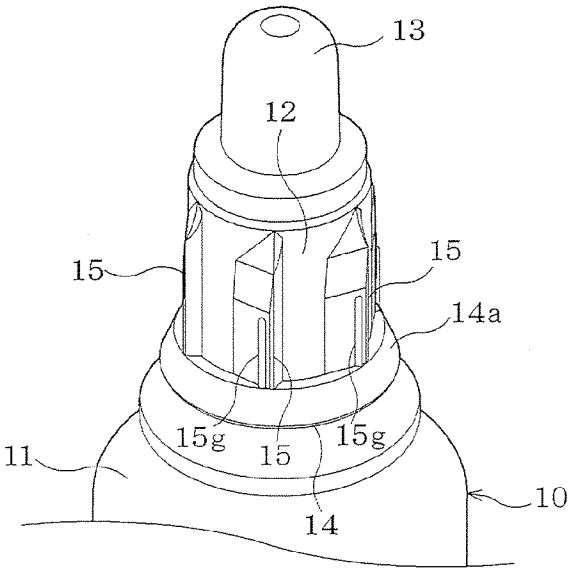
(B)
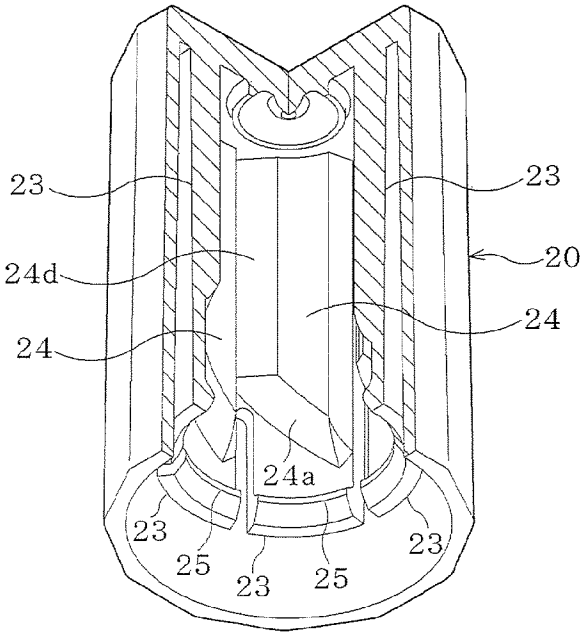
(A)
[Fig.21]

[Fig.22]
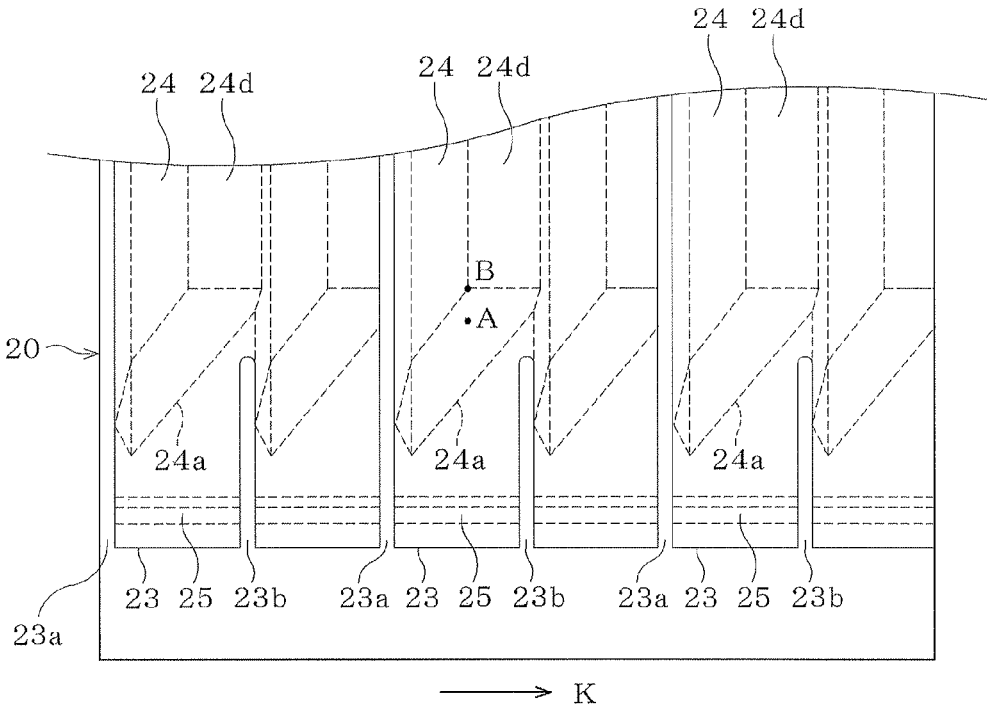
(A)
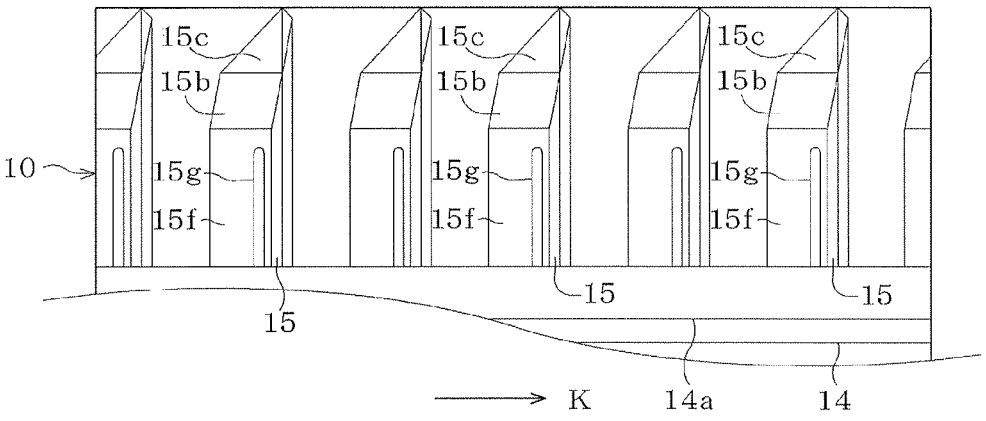
(B)

[Fig.23]
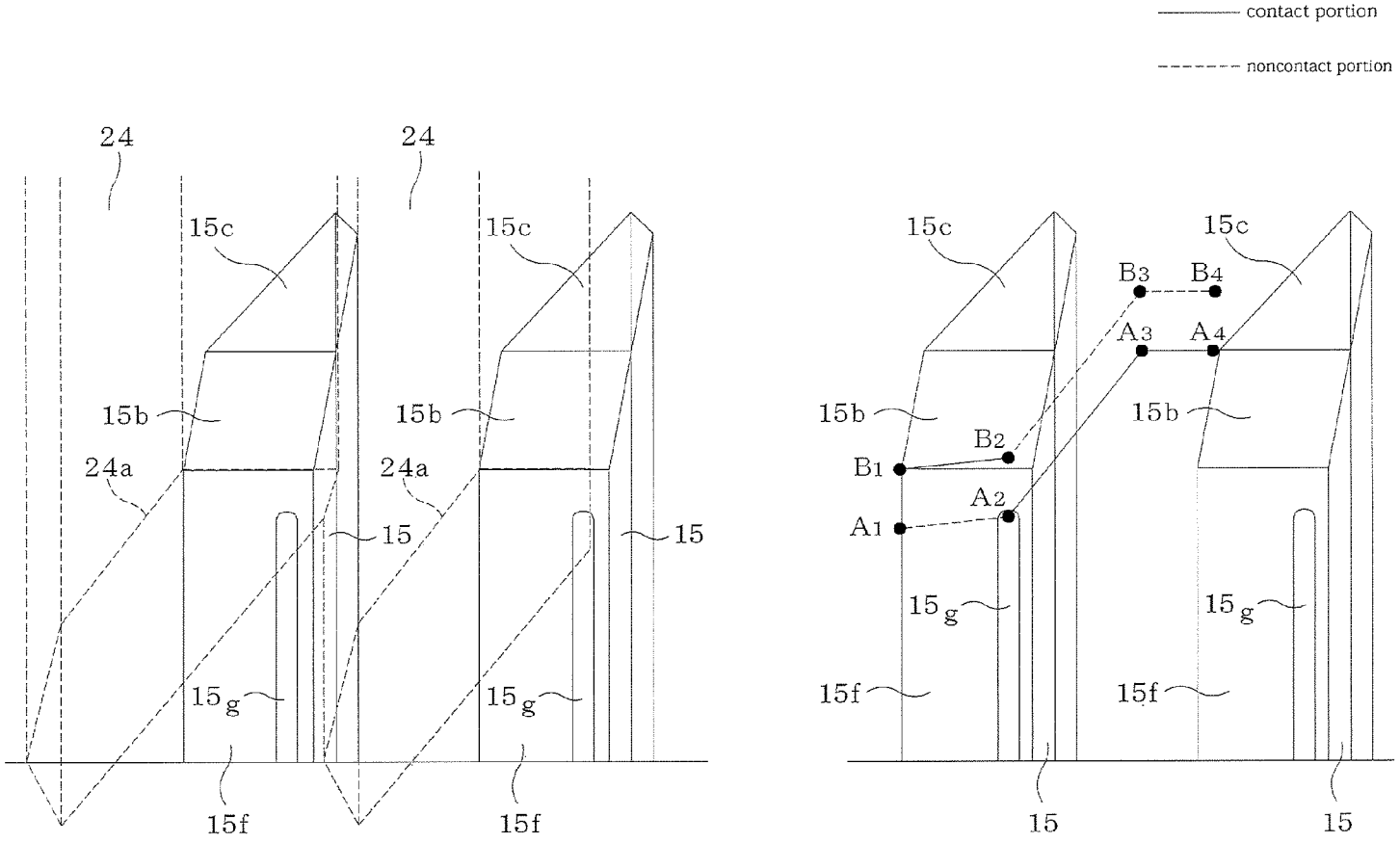

PACKAGING CONTAINER

TECHNICAL FIELD

The present invention relates to packaging containers suitable for storing various medical fluids and tablets, and others.

BACKGROUND ART

A so-called twist-type cap is sometimes used for opening and closing the mouth of a flat container body (e.g. Patent Documents 1 to 3).

A twist-type cap can be attached to the mouth of a container body simply by pressing axially, and can be removed simply by rotating about 45°, for example, in an opening direction to open the mouth. Specifically, locking claws to elastically lock into a locking portion on the outer perimeter of the mouth are extended down inside the cap. Thus, by axially pressing the cap, locking the locking claws into the locking portion on the mouth side, the cap can be attached to the mouth in one action to close the mouth. When the cap is rotated by a predetermined angle, a linear portion at its lower edge goes up on an oblique shoulder portion of a flat container body, and the cap is driven in a removing direction and can be easily removed.

PRIOR ART DOCUMENTS

Patent Documents

Patent Document 1: JP-Y2-Hei-6-39714
Patent Document 2: JP-A-Hei-10-329855
Patent Document 3: JP-A-2009-249007

SUMMARY OF THE INVENTION

Problems to be Solved by the Invention

According to the conventional art, the twist-type cap is removed by the linear portion at its lower edge going up on the oblique shoulder portion of the container body. Thus, the shapes of the container body and the cap are limited to flat shapes, causing a problem that the degree of freedom in design is limited. Further, at the time of opening, by driving the cap in the removing direction, the locking claws locking into the locking portion on the mouth side are forcibly released, so that required turning force tends to be excessively large. An attempt to reduce the turning force cannot avoid the problem that retaining power afforded by the locking claws tends to be insufficient.

Thus, in view of the problems of the conventional art, an object of the invention is to provide a packaging container that causes locking claws on the cap side to elastically deform radially at the time of opening, thereby improving the degree of freedom in the shapes of a container body and a cap, and preventing required turning force from being excessively large.

Solutions to the Problems

To achieve this object, a configuration of this invention is summarized in that it includes a container body having an upward-facing mouth, and a cap for closing the mouth, the container body having a plurality of axial drive ribs and a circumferential locking groove formed on an outer perimeter of the mouth, the cap having protruding rib portions to engage with the drive ribs on an inner surface side and a plurality of locking claws to elastically lock into the locking groove, extended down from a top surface thereof, in which when the cap in a closed state is turned in an opening direction, each of locking claws elastically deform radially via the drive ribs and the protruding rib portions to come off the locking groove, and the cap relatively moves upward to become removable.

Each drive rib may have an inclined surface or a rib formed to relatively move the cap upward.

The locking claws may be axially separated via slits. Each of locking claws may be increased in rigidity in the direction of opening the cap. Each drive rib and each protruding rib portion may be pointed upward and downward, respectively.

Effects of the Invention

According to this configuration of the invention, when the cap in the closed state attached to the mouth of the container body is rotated in the opening direction, the protruding rib portions on the cap side engage with the drive ribs on the mouth side, and each locking claw on the cap side elastically deform radially and come off the locking groove on the mouth side. Thus, the cap substantially loses retaining force by each locking claw. Therefore, by further rotating the cap in the opening direction, it relatively moves upward and can be smoothly removed from the mouth to open the mouth. The cap causes each locking claw to elastically deform via the drive ribs and the protruding rib portions engaging with each other, and to produce drive force required for its upward relative movement. Therefore, the shapes of the container body and the cap are not limited to flat shapes. By setting the positions of engagement between the drive ribs and the protruding rib portions in the initial stage during opening near the lower ends of each locking claw, the cap can sufficiently reduce turning force required at the time of opening.

On each drive rib, an inclined surface facing obliquely upward in the direction of opening the cap may be formed. By engaging the protruding rib portions on the cap side with the inclined surfaces, the cap can be relatively moved upward to be smoothly removed from the mouth. In conjunction with that, however, an engaging oblique surface bulging out radially is formed on each drive rib. The protruding rib portions on the cap side engage with the engaging oblique surfaces before engaging with the obliquely upward-facing inclined surfaces, thereby previously elastically deforming the corresponding locking claws radially to release them from the locking groove on the mouth side. In place of the inclined surface, an axial rib may be formed on each drive rib so that inclined surfaces formed on the protruding rib portions on the cap side are engaged with the ribs to relatively move the cap upward.

The locking claws on the cap side may be axially separated via slits so that the rigidity in radial elastic deformation is made uniform to more reliably release the locking claws from the locking groove on the mouth side. Each locking claw may be increased in rigidity in the direction of opening the cap so that the force of turning the cap required in the initial stage of opening is relatively sufficiently reduced to improve operability.

By pointing each drive rib and each protruding rib portion upward and downward, respectively, when the cap is attached to the mouth for closing, the drive ribs and the protruding rib portions are meshed vertically to automatically guide the cap to a proper relative rotational position, allowing the cap to be easily attached to the mouth only by axially pressing the cap.

BRIEF DESCRIPTION OF THE DRAWINGS

FIGS. 1(A) and 1(B) are perspective explanatory diagrams of an entire configuration.

FIGS. 2(A) and 2(C) are explanatory diagrams of the entire configuration.

FIGS. 3(A) and 3(B) are explanatory diagrams of the configuration of a principal portion.

FIG. 4 is a schematic developed view of the inner surface side of locking claws.

FIG. 5 is a schematic developed view of the outer surface side of the locking claws.

FIG. 6 is a schematic developed view of the outer perimeter of a mouth.

FIGS. 7(A) and 7(B) are explanatory diagrams (1) of movements.

FIGS. 8(A)-(D) are explanatory diagrams (2) of movements.

FIGS. 9(A)-9(D) are explanatory diagrams (3) of movements.

FIG. 10 is a diagram corresponding to FIG. 5, illustrating another embodiment.

FIGS. 11(A) and 11(B) are explanatory diagrams (1) of the configuration of a principal portion, illustrating another embodiment.

FIGS. 12(A) and 12(B) are explanatory diagrams (2) of the configuration of a principal portion, illustrating another embodiment.

FIGS. 13(A) and 13(B) are explanatory diagrams (3) of the configuration of a principal portion, illustrating another embodiment.

FIGS. 14(A) and 14(B) are diagrams (1) corresponding to FIGS. 1(A) and 1(B), illustrating another embodiment.

FIGS. 15(A) and 15(B) are diagrams (2) corresponding to FIGS. 1(A) and 1(B), illustrating another embodiment.

FIGS. 16(A) and 16(B) are explanatory diagrams of the configuration of a drive rib, illustrating another embodiment.

FIGS. 17(A)-17(C) are explanatory diagrams of the configuration of a protruding rib portion, illustrating another embodiment.

FIGS. 18(A) and 18(B) are diagrams (3) corresponding to FIGS. 1(A) and 1(B), illustrating another embodiment.

FIGS. 19(A) and 19(B) are schematic developed explanatory diagrams of a principal portion in FIGS. 18(A) and 18(B).

FIGS. 20(A) and 20(B) are explanatory diagrams of movements in FIGS. 18(A) and 18(B).

FIGS. 21(A) and 21(B) are diagrams (4) corresponding to FIGS. 1(A) and 1(B), illustrating another embodiment.

FIGS. 22(A) and 22(B) are schematic developed explanatory diagrams of a principal portion in FIGS. 21(A) and 21(B).

FIGS. 23(A) and 23(B) are explanatory diagrams of movements in FIGS. 21(A) and 21(B).

MODE FOR CARRYING OUT THE INVENTION

Hereinafter, with reference to the drawings, an embodiment of the invention will be described.

A packaging container includes a container body 10 and a cap 20 (FIGS. 1 and 2). FIGS. 1(A) and 1(B) are a partly cutaway overall perspective view of the cap 20 and an overall perspective view of the container body 10, respectively. FIGS. 2(A) to 2(C) are a vertical cross-sectional view of the cap 20, a front view of a principal portion of the container body 10, and a vertical cross-sectional view of a combined state of the cap 20 and the container body 10, respectively.

The container body 10 is, for example, an eye drop container, and is made by forming an upward-facing cylindrical mouth 12 on a bottomed cylindrical barrel portion 11, and pressing a nozzle chip 13 with a nozzle hole 13*a* into the mouth 12 (FIG. 1(B) and FIGS. 2(B) and 2(C)). An outer flange 11*a* is formed between the mouth 12 and the barrel portion 11. Above the outer flange 11*a*, a circumferential locking groove 14 and an obliquely downward-facing flange 14*a* are formed. The top surface side and the lower surface side of the flange 14*a* are formed with long and short oblique surfaces, respectively. Above the flange 14*a*, axial drive ribs 15, 15, . . . are formed on the outer perimeter of the mouth 12 with an equal pitch.

The cap 20 is formed in a substantially cylindrical shape with the upper end closed, and with the diameter slightly expanded downward (FIG. 1(A) and FIGS. 2(A) and 2(C)).

On the outer surface of the cap 20, axial non-slip flat surfaces 21, 21, . . . are formed. A protruding plug 22 with a seal ring 22*a* matching the nozzle chip 13 and the nozzle hole 13*a* on the container body 10 side is formed at a central portion of the top surface of the cap 20. Locking claws 23, 23, . . . curved in an arc shape are extended down in a ring shape from the top surface of the cap 20, disposed with an equal pitch. An axial protruding rib portion 24 is formed on the inner surface side of each locking claw 23. An inward-facing hook 25 is formed at the lower end of each locking claw 23. By attaching the cap 20 to the mouth 12 of the container body 10, covering the nozzle chip 13, and elastically locking the hooks 25, 25, . . . of the locking claws 23, 23, . . . to the flange 14*a* and the locking groove 14, the nozzle hole 13*a* of the nozzle chip 13 can be sealed by the protruding plug 22 and the seal ring 22*a* to close the container body 10 (FIG. 2(C)).

The locking claws 23, 23, . . . are axially separated via longer and shorter slits 23*a*, 23*a*, . . . , and 23*b*, 23*b*, . . . by each protruding rib portion 24 (FIG. 2(A) and FIG. 3(A)). The longer slits 23*a* reach the top surface of the cap 20 from the lower ends of the locking claws 23 and 23 on both right and left sides. The shorter slits 23*b* extend from the lower ends of the locking claws 23 and 23 to intermediate portions. The inner surface side of each locking claw 23 is thin-walled into a predetermined shape between the intermediate portion to the hook 25 at the lower end, and the thick-walled protruding rib portion 24 is formed in a downward pointed shape. On the other hand, the outer perimeter of the mouth 12 on the container body 10 side is thin-walled into a predetermined shape above the flange 14*a*, and the thick-walled drive ribs 15, 15, . . . are formed in an upward pointed shape (FIG. 2(B) and FIG. 3(B)). FIG. 3(A) is a cross-sectional view corresponding to an arrow view along line X-X in FIG. 2(A). FIG. 3(B) is a top view of the container body 10.

The axial protruding rib portions 24, 24, . . . on the cap 20 side and the axial drive ribs 15, 15, . . . on the container body 10 side are schematically illustrated in FIGS. 4 to 6. FIGS. 4 and 5 are schematic developed diagrams when viewed from the inner surface side and the outer surface side of the locking claws 23, 23, . . . of the cap 20, respectively. FIG. 6 is a schematic developed diagram of the outer perimeter of the mouth 12 of the container body 10. In FIGS. 4 to 6, each of the direction of an arrow K represents the direction of opening the cap 20. Hereinafter, on each protruding rib portion 24 and each drive rib 15, the forward side and the rearward side in the direction of opening the cap 20 are referred to as the forward edge side and the rearward edge side, respectively.

On the upper end of each drive rib 15 on the container body 10 side, an obliquely upward-facing inclined surface 15*a* is formed from the rearward edge side to the forward edge side (FIG. 6). An engaging oblique surface 15*b* bulging out obliquely in a radial direction of the mouth 12 is axially formed on the rearward edge side of a proximal portion of each drive rib 15. The upper end of the oblique surface 15*b* is connected to the lower end of the inclined surface 15*a* via a connecting oblique surface 15*c*. The forward edge side of each drive rib 15 is demarcated by a small oblique surface 15*d* corresponding to the upper end of the inclined surface 15*a* and an axial oblique surface 15*e* of a small width. Each drive rib 15 is formed in an upward pointed shape with the inclined surface 15*a* and the oblique surfaces 15*d* and 15*e*. A lower portion of the oblique surface 15*e* abuts on the rearward edge side of the engaging oblique surface 15*b* of another drive rib 15 adjacent to the forward edge side.

The axial protruding rib portions 24, 24, . . . on the cap 20 side are formed in a small-width shape at their lower half portions (FIGS. 4 and 5). Upper half portions thereof are widened to the forward edge side by downward-facing inclined surfaces 24*a* corresponding to the inclined surfaces 15*a* on the container body 10 side, and are formed in a downward-facing substantially triangular shape. The lower end of each protruding rib portion 24 is formed in a downward pointed shape by a downward-facing oblique surface 24*b* and a triangular oblique surface 24*c* on the forward edge side. On the forward edge side of each protruding rib portion 24, an axial connecting oblique surface 24*d* is formed between the lower end of the inclined surface 24*a* above and the oblique surface 24*c* below. The rearward edge side of each protruding rib portion 24 is demarcated by an axial oblique surface 24*e* of a small width. An upper end portion of the oblique surface 24*e* abuts on an upper end portion of the inclined surface 24*a* of another protruding rib portion 24 adjacent to the rearward edge side, and a lower end portion abuts on the rearward edge side of the oblique surface 24*b*.

When the cap 20 is attached to the mouth 12 to close the container body 10, the cap 20 only needs to be moved from above the container body 10 downward to be put over the nozzle chip 13, and to be axially pressed down until the hooks 25, 25, . . . of the locking claws 23, 23, . . . are properly locked in the locking groove 14, and the nozzle hole 13*a* of the nozzle chip 13 is sealed (FIG. 2(C)). This is because the downward-pointed protruding rib portions 24, 24, . . . on the cap 20 side vertically mesh with the upward-pointed drive ribs 15, 15, . . . on the container body 10 side, thereby properly aligning the centers of the cap 20 and the mouth 12 and the nozzle chip 13 of the container body 10, and allowing the cap 20 to be automatically relatively rotated with respect to the container body 10 to be positioned so that each protruding rib portion 24 property enters between the adjacent drive ribs 15 and 15 (FIG. 7(A)). FIG. 7(A) is an enlarged schematic developed diagram of a principal portion illustrating the relative positional relationship between each protruding rib portion 24 in FIG. 5 and each drive rib 15 in FIG. 6 when the container body 10 is closed by the cap 20.

In a closed state of the container body 10, a lower end position on the forward edge side of any protruding rib portion 24 on the cap 20 side (e.g. a point A in FIGS. 4 and 5) and an engaging part corresponding to a joint position between the forward edge side of the protruding rib portion 24 and the lower end of the inclined surface 24*a* (e.g. a point B in FIGS. 4 and 5, hereinafter, referred to as an engaging part of the protruding rib portion 24) are located at points A1 and B1 in FIG. 7(B), respectively, with respect to the corresponding drive rib 15 on the container body 10 side. At this time, the protruding rib portions 24, 24, . . . on the cap 20 side mesh with the drive ribs 15, 15, . . . on the container body 10 side, restraining the cap 20 so that the cap 20 is rotatable only in the opening direction (FIG. 8(A)), the hooks 25, 25, . . . of each locking claw 23 of the cap 20 elastically lock to the locking groove 14 and the flange 14*a* on the container body 10 side (FIG. 9(A)), and the cap 20 seals the nozzle hole 13*a* of the nozzle chip 13.

FIGS. 8(A) to 8(D) are enlarged cross-sectional views individually corresponding to an arrow view along line Y-Y in FIG. 2(C), illustrating the state of movement when the cap 20 in the closed state is opened. FIGS. 9(A) to 9(D) are vertical cross-sectional movement diagrams corresponding to FIGS. 8(A) to 8(D), respectively.

When the cap 20 in the closed state (before opened) is turned in the opening direction (each of the direction of the arrow K in FIGS. 4 to 6, and FIGS. 8(B) and 8(C)), the lower end position A on the forward edge side of each protruding rib portion 24 goes up onto the rearward edge side of the corresponding drive rib 15 (points A1 to A2 in FIG. 7(B) and FIG. 8(B)). Thus, each locking claw 23 elastically deform radially, and the hooks 25, 25, . . . come off the locking groove 14 and the flange 14*a* (FIG. 9(B)). The cap 20 slightly relatively moves upward mainly due to the elasticity of the nozzle chip 13. At this time, the locking claws 23, 23, . . . elastically deform radially, increasing the space of the longer slits 23*a*, 23*a*, . . . (FIG. 8(B)). The space of the shorter slits 23*b*, 23*b*, . . . is hardly increased. At this time, the engaging part B of each protruding rib portion 24 reaches engagement with the top of the inclined surface 15*a* on the drive rib 15 side (points B1 to B2 in FIG. 7(B)).

Subsequently, when the cap 20 is further turned in the opening direction, the engaging part B of each protruding rib portion 24 travels obliquely upward along the corresponding inclined surface 15*a* (points B2 to B3 in FIG. 7(B) and FIG. 8(C)). With this, the cap 20 relatively moves upward, opening the nozzle hole 13*a* of the nozzle chip 13 (FIG. 9(C)), and allowing the container body 10 to be opened. At this time, the hooks 25, 25, . . . of each locking claw 23 have substantially gone over the maximum-diameter position of the flange 14*a* from below to above.

Thus, when the cap 20 is further turned in the opening direction, rotated by one pitch of the drive ribs 15, 15, . . . and the protruding rib portions 24, 24, . . . from the initial unopened state, the engaging part B of each protruding rib portion 24 comes off the corresponding inclined surface 15*a* and crosses the oblique surface 15*e* on the forward edge side of the drive rib 15 (points B3 to B4 in FIG. 7(B)). Thus, the protruding rib portions 24 come off the drive ribs 15, and each locking claw 23 returns from the radial elastic deformation to the original form (FIG. 8(D)). With that, the hooks 25, 25, . . . of each locking claw 23 slide along the oblique top surface of the flange 14*a*, relatively moving the cap 20 upward (FIG. 9(D)). The cap 20, whose opening has been completed, can be removed freely upward from the container body 10.

A solid line of the points A1 to A2 and a dotted line of points A2 to A3 to A4 in FIG. 7(B) represent a contact portion and a noncontact portion of the lower end position A on the forward edge side of the protruding rib portion 24 with respect to the drive rib 15 side, respectively. A dotted line of points B1 to B2 and a solid line of points B2 to B3 to B4 represent a noncontact portion and a contact portion of the engaging part B of the protruding rib portion 24 with respect to the drive rib 15 side, respectively.

OTHER EMBODIMENTS

The shorter slits 23*b*, 23*b* may be eliminated so that the locking claws 23, 23, . . . on the cap 20 side are axially separated only via the longer slits 23*a*, 23*a*, . . . by a pair of right and left protruding rib portions 24 and 24 (FIG. 10). The locking claws 23 can be further enhanced in rigidity when each locking claw 23 is elastically deformed radially by rotating the cap 20 in the opening direction.

Each locking claw 23 of the cap 20 may have a radial reinforcing rib 23*c* on the rearward side in the opening direction of the cap 20, formed at a proximal portion on the outer surface side, thereby being increased in rigidity in the direction of opening the cap 20 (FIG. 11). Required turning force in the initial stage can be relatively reduced to improve operability when the cap 20 is turned in the opening direction. FIGS. 11(A) and 11(B) are a diagram corresponding to FIG. 9(A) and a cross-sectional view corresponding to an arrow view along line X-X in FIG. 11(A), respectively. The direction of an arrow K in FIG. 11(B) represents the direction of opening the cap 20.

Each locking claw 23 of the cap 20 may have a thick-walled portion 23*d* smoothly increasing in thickness from the forward side to the rearward side in the direction of opening the cap 20, and also from an intermediate potion to a proximal portion above, individually, formed on the outer surface side (FIG. 12), thereby being increased in rigidity in the direction of opening the cap 20 to achieve the same effect as in FIG. 11. FIGS. 12(A) and 12(B) are diagrams corresponding to FIGS. 11(A) and 11(B), respectively. The direction of an arrow K in FIG. 12(B) represents the direction of opening the cap 20.

The hook 25 on the inner surface side of each locking claw 23 of the cap 20 may be formed in an intermediate position higher than the lower end (FIG. 13). In this case, the protruding rib portion 24 of each locking claw 23 can be extended below the hook 25 and pointed downward (FIG. 13(A)). For the locking groove 14 and the flange 14*a* on the container body 10 side to be aligned with the hooks 25, the former is formed in a large-width shape, and the latter is formed in an intermediate position on the outer perimeter of the mouth 12 (FIG. 13(B)). Each drive rib 15 on the container body 10 side is also extended to the outer flange 11*a* below the flange 14*a*. Since each protruding rib portion 24 is pointed downward at the lower end of the locking claw 23, the protruding rib portions 24, 24, . . . can be more smoothly meshed with the drive ribs 15, 15, . . . when the cap 20 is attached, improving operability. FIGS. 13(A) and 13(B) are diagrams corresponding to FIGS. 2(A) and 2(B), respectively.

The container body 10 may be a wide-mouth tablet container, for example (FIG. 14). For the cap 20 in this case, packing 26 is fitted on the top surface, and the upper ends of the longer slits 23*a*, 23*a*, . . . axially separating the locking claws 23, 23, . . . are formed to a length that does not reach the top surface of the cap 20, in order to continuously form an annular rib 26*a* for retaining the packing 26 on the inner surface side of proximal portions of the locking claws 23, 23, . . . . FIGS. 14(A) and 14(B) are diagrams corresponding to FIGS. 1(A) and 1(B), respectively.

It is generally preferable to dispose a predetermined number m of drive ribs 15, 15, . . . on the container body 10 side with an equal pitch in contact with each other on the outer perimeter of the mouth 12 via the oblique surfaces 15*b* and 15*e* associated with the rearward edge side and the forward edge side, respectively (FIG. 6 and FIG. 14(B)). On the other hand, the same number n=m of locking claws 23, 23, . . . with the protruding rib portions 24 on the cap 20 side as the drive ribs 15, 15, . . . may be disposed with the same pitch so that the protruding rib portions 24, 24, . . . properly mesh with the drive ribs 15, 15, . . . vertically. However, a number n ($2 \le n \le m$) of locking claws 23, 23, . . . may be disposed, evenly distributed on the outer perimeter of the mouth 12 as long as the protruding rib portions 24, 24, . . . can properly mesh with the drive ribs 15, 15, . . . . Alternatively, n groups of any number $a \ge 1$ of locking claws 23, 23, . . . ($an \le m$) may be disposed, evenly distributed on the outer perimeter of the mouth 12. Further, when two or more locking claws 23, 23, . . . are associated with one drive rib 15, and elastically deformed radially at a stroke, the number n of the locking claws 23, 23, . . . can be greater than m.

Each drive rib 15 on the container body 10 side and each protruding rib portion 24 on the cap 20 side may be pointed upward and downward in symmetrical shapes, respectively (FIG. 15). The cap 20 in this case can be turned in either right or left direction to be opened (the directions of arrows K and K in FIG. 15(A)). FIGS. 15(A) and 15(B) are diagrams corresponding to FIGS. 1(A) and 1(B), respectively.

The drive ribs 15 on the container body 10 side to be combined with each protruding rib portion 24 on the cap 20 side in FIGS. 1(A), 4, and 5 may be changed in shape as in FIGS. 16(A) to 16(C), for example. Specifically, the engaging oblique surface 15*b* on the rearward edge side of the proximal portion may be extended upward to be directly connected to the lower end of the inclined surface 15*a* (the same figure (A)). The connecting oblique surface 15*c* in the intermediate portion on the rearward edge side may be extended downward to eliminate the engaging oblique surface 15*b* (the same figure (B)). The inclined surface 15*a* and the connecting oblique surface 15*c* may be made continuous in the form of a smooth curved surface (the same figure (C)).

The protruding rib portions 24 on the cap 20 side to be combined with each drive rib 15 on the container body 10 side in FIGS. 1(B) and 6 may be changed in shape as in FIGS. 17(A) to 17(C), for example. Specifically, instead of being formed in a small-width shape, the lower-half portion of each protruding rib portion 24 may be formed in a chevron shape in cross section with oblique surfaces 24*d* and 24*e* on the forward edge side and the rearward edge side (the same figure (A)). In place of the inclined surface 24*a*, an axial inclined surface 24*g* may be formed above the oblique surface 24*d* on the forward edge side via a small oblique surface 24*f* (the same figure (B)). Further, the oblique surface 24*d* on the forward edge side may be axially extended directly upward, and an axial engaging rib 24*h* may be formed on the oblique surface 24*d* (the same figure (C)). In FIGS. 17(A) to 17(C), a point A and a point B corresponding to the point A and the point B in FIGS. 4 and 5, respectively are also illustrated. The point B in FIG. 17(C) corresponds to the lower end of the rib 24*h*. The cross-sectional shape of the rib 24*h* is not limited to a semicircular shape, and may be a semicylindrical shape, a triangular shape, a quadrilateral shape, or the like.

For each drive rib 15 on the container body 10 side, the obliquely upward-facing inclined surface 15*a* may be formed on the rearward edge side of a lower portion, and the engaging oblique surface 15*b* and the connecting oblique surface 15*c* may be formed in order above the inclined surface 15*a* (FIGS. 18(B) and 19(B)). In this case, each protruding rib portion 24 on the cap 20 side is axially formed in a wide-width shape of a fixed width, and has the inclined surface 24*a* formed at the lower end and the axial oblique surface 24*d* on the forward edge side (FIGS. 18(A) and 19(A)).

Thus, in the closed state (before opened) of the cap 20, the protruding rib portions 24, 24, . . . can properly mesh with the drive ribs 15, 15, vertically (FIG. 20(A)). When the cap 20 is turned in the opening direction (each of the direction of an arrow K in FIGS. 19(A) and 19(B)), lower end positions on the rearward edge side and the forward edge side of each protruding rib portion 24 (e.g. points A and B in FIG. 19(A)) relatively move along the paths of points A1 to A4 and points B1 to B4 in FIG. 20(B) with respect to the corresponding drive rib 15, respectively, thereby allowing the cap 20 to be opened. At the points B1 to B2 in FIG. 20(B), the locking claws 23, 23, . . . of the cap 20 elastically deform radially, and the hooks 25, 25, . . . come off the locking groove 14. At the points A2 to A3 in FIG. 20(B), the cap 20 relatively moves upward. FIGS. 18(A) and 18(B) are diagrams corresponding to FIGS. 1(A) and 1(B), respectively. FIGS. 19(A) and 19(B) are diagrams corresponding to FIGS. 5 and 6, respectively. FIGS. 20(A) and 20(B) are diagrams corresponding to FIGS. 7(A) and 7(B), respectively.

The protruding rib portions 24, 24, . . . on the cap 20 side in the same form as in FIGS. 18 to 20 can be combined with the drive ribs 15, 15, . . . of a small width on the container body 10 side with engaging ribs 15*g* formed on axial oblique surfaces 15*f* on the rearward edge side (FIGS. 21 to 23). FIGS. 21(A) and 21(B), FIGS. 22(A) and 22(B), and FIGS. 23(A) and 23(B) are diagrams corresponding to FIGS. 18(A) and 18(B), FIGS. 19(A) and 19(B), and FIGS. 20(A) and 20(B), respectively.

In the closed state of the cap 20 (before opened), the protruding rib portions 24, 24, . . . properly mesh with the drive ribs 15, 15, . . . vertically (FIG. 23(A)). When the cap 20 in the closed state is turned in the direction of opening the cap 20 (each of the direction of an arrow K in FIGS. 22(A) and 22(B)), the lower end of each protruding rib portion 24 on the forward edge side (e.g. a point B in FIG. 22(A)) relatively moves as shown by points B1 to B2 in FIG. 23 (B) with respect to the corresponding drive rib 15, elastically deforming the locking claws 23, 23, . . . radially, and a point on the lower inclined surface 24*a* of each protruding rib portion 24 on the forward edge side (e.g. a point A in FIG. 22(A)) reaches engagement with the upper end of the rib 15*g* of the drive rib 15 on the rearward edge side (points A1 to A2 in FIG. 23(B)). Thus, by further turning the cap 20 in the opening direction, the upper end of each rib 15*g* relatively moves along the inclined surface 24*a*, so that the cap 20 relatively moves upward (points A2 to A3 in FIG. 23(B)), and the opening movement can be smoothly completed (points A3 to A4 in the same figure).

This application claims the benefit of priority based on Japanese patent application No. 2014-233278 filed on Nov. 18, 2014. The entire contents of Japanese patent application No. 2014-233278 filed on Nov. 18, 2014 is incorporated herein by reference.

INDUSTRIAL APPLICABILITY

This invention is widely suitably applicable to packaging containers for various uses such as any medical fluid container including eyedroppers, tablet containers, and ointment containers.

DESCRIPTION OF REFERENCE SIGNS

10 . . . container body
12 . . . mouth
14 . . . locking groove
15 . . . drive rib
15*a* . . . inclined surface
15*g* . . . rib
20 . . . cap
23 . . . locking claw
23*a*, 23*b* . . . slit
24 . . . protruding rib portion

The invention claimed is:

1. A packaging container comprising: a container body having an upward-facing mouth; and a cap for closing the mouth, the container body having a plurality of axial drive ribs and a circumferential locking groove formed on an outer perimeter of the mouth, the cap having a plurality of locking claws that has protruding rib portions to engage with the drive ribs on an inner surface side and elastically locks into the locking groove, extended down from a top surface thereof, wherein when the cap in a closed state is turned in an opening direction, via the drive ribs and the protruding rib portions, each of the locking claws elastically deform radially to come off the locking groove and the cap relatively moves upward to become removable, and the drive ribs and the protruding rib portions are in engagement with each other until each of the locking claws that have elastically deformed come off the locking groove and return to an original form.

2. The packaging container according to claim 1, wherein each of the drive ribs has an inclined surface formed to relatively move the cap upward.

3. The packaging container according to claim 1, wherein each of the drive ribs has a rib formed to relatively move the cap upward.

4. The packaging container according to claim 1, wherein the plurality of locking claws has slits interposed therebetween.

5. The packaging container according to claim 1, wherein each of the locking claws has, on a rearward side in the direction of opening the cap, a radial reinforcing rib formed at a proximal portion of the locking claw on an outer surface side, or has a thick-walled portion smoothly increasing in thickness from a forward side to a rearward side in the direction of opening the cap, or from an intermediate portion to a proximal portion above, individually, formed on an outer surface side of the cap.

6. The packaging container according to claim 1, wherein the drive ribs and the protruding rib portions are pointed upward and downward, respectively.

7. The packaging container according to claim 2, wherein the plurality of locking claws has slits interposed therebetween.

8. The packaging container according to claim 3, wherein the plurality of locking claws has slits interposed therebetween.

9. The packaging container according to claim 2, wherein each of the locking claws has, on a rearward side in the direction of opening the cap, a radial reinforcing rib formed at a proximal portion of the locking claw on an outer surface side, or has a thick-walled portion smoothly increasing in thickness from a forward side to a rearward side in the direction of opening the cap, or from an intermediate portion to a proximal portion above, individually, formed on an outer surface side of the cap.

10. The packaging container according to claim 3, wherein each of the locking claws has, on a rearward side in the direction of opening the cap, a radial reinforcing rib formed at a proximal portion of the locking claw on an outer surface side, or has a thick-walled portion smoothly increasing in thickness from a forward side to a rearward side in the direction of opening the cap, or from an intermediate portion to a proximal portion above, individually, formed on an outer surface side of the cap.

11. The packaging container according to claim 4, wherein each of the locking claws has, on a rearward side in the direction of opening the cap, a radial reinforcing rib formed at a proximal portion of the locking claw on an outer surface side, or has a thick-walled portion smoothly increasing in thickness from a forward side to a rearward side in the direction of opening the cap, or from an intermediate portion to a proximal portion above, individually, formed on an outer surface side of the cap.

12. The packaging container according to claim 7, wherein each of the locking claws has, on a rearward side in the direction of opening the cap, a radial reinforcing rib formed at a proximal portion of the locking claw on an outer surface side, or has a thick-walled portion smoothly increasing in thickness from a forward side to a rearward side in the direction of opening the cap, or from an intermediate portion to a proximal portion above, individually, formed on an outer surface side of the cap.

13. The packaging container according to claim 8, wherein each of the locking claws has, on a rearward side in the direction of opening the cap, a radial reinforcing rib formed at a proximal portion of the locking claw on an outer surface side, or has a thick-walled portion smoothly increasing in thickness from a forward side to a rearward side in the direction of opening the cap, or from an intermediate portion to a proximal portion above, individually, formed on an outer surface side of the cap.

14. The packaging container according to claim 2, wherein the drive ribs and the protruding rib portions are pointed upward and downward, respectively.

15. The packaging container according to claim 3, wherein the drive ribs and the protruding rib portions are pointed upward and downward, respectively.

16. The packaging container according to claim 4, wherein the drive ribs and the protruding rib portions are pointed upward and downward, respectively.

17. The packaging container according to claim 5, wherein the drive ribs and the protruding rib portions are pointed upward and downward, respectively.

* * * * *